US010167630B2

(12) United States Patent
Giles

(10) Patent No.: US 10,167,630 B2
(45) Date of Patent: Jan. 1, 2019

(54) FOAM WALL STRUCTURES AND METHODS FOR THE MANUFACTURE THEREOF

(71) Applicant: Covestro LLC, Pittsburgh, PA (US)

(72) Inventor: Eric C. Giles, Pittsburgh, PA (US)

(73) Assignee: COVESTRO LLC, Pittsburgh, PA (US)

( * ) Notice: Subject to any disclaimer, the term of this patent is extended or adjusted under 35 U.S.C. 154(b) by 0 days.

(21) Appl. No.: 15/332,284

(22) Filed: Oct. 24, 2016

(65) Prior Publication Data

US 2018/0112394 A1 Apr. 26, 2018

(51) Int. Cl.

| | |
|---|---|
| ***E04B 1/76*** | (2006.01) |
| ***E04B 1/80*** | (2006.01) |
| ***E04B 2/56*** | (2006.01) |
| ***E04C 2/20*** | (2006.01) |
| ***E04C 2/38*** | (2006.01) |
| *E04B 2/70* | (2006.01) |

(52) U.S. Cl.

CPC ..... *E04B 1/7658* (2013.01); *E04B 1/7629* (2013.01); *E04B 1/80* (2013.01); *E04B 2/562* (2013.01); *E04C 2/205* (2013.01); *E04C 2/38* (2013.01); *E04B 1/7637* (2013.01); *E04B 2/70* (2013.01)

(58) Field of Classification Search

CPC .... E04B 1/7658; E04B 1/7629; E04B 1/7637; E04B 1/74; E04B 1/7608; E04B 1/7612; E04B 1/7625; E04B 1/7675; E04B 1/80; E04B 1/14; E04B 1/6145; E04B 1/22; E04B 1/26; E04B 2001/386; E04B 2001/2481; E04B 2001/8263; E04B 2/562; E04B 2/70; E04C 2/10; E04C 2/20; E04C 2/205; E04C 2/24; E04C 2/243; E04C 2/246; E04C 2/38; E04C 2/382; E04C 2/384; E04C 2/386; E04C 2/388

See application file for complete search history.

(56) References Cited

U.S. PATENT DOCUMENTS

| | | | | |
|---|---|---|---|---|
| 3,785,913 | A * | 1/1974 | Hallamore | E04C 2/284 156/71 |
| 4,443,988 | A | 4/1984 | Coutu, Sr. | |
| 4,471,591 | A | 9/1984 | Jamison | |
| 4,671,038 | A | 6/1987 | Porter | |
| 4,765,105 | A | 8/1988 | Tissington et al. | |
| 4,856,244 | A | 8/1989 | Clapp | |
| 5,353,560 | A | 10/1994 | Heydon | |
| 5,389,167 | A * | 2/1995 | Sperber | B05B 7/0025 156/291 |
| 5,950,386 | A | 9/1999 | Shipman et al. | |

(Continued)

OTHER PUBLICATIONS

Grisolia, Anthony et al; U.S. Appl. No. 14/816,589; Title: Wall Structure Penetration Attachment; Assigned to: Covestro LLC; filed Aug. 3, 2015.

(Continued)

*Primary Examiner* — Jessica L Laux

(74) *Attorney, Agent, or Firm* — Donald R. Palladino

(57) ABSTRACT

Wall structures and methods of manufacturing wall structures are described in this specification. The wall structures include a frame, a first foam panel attached to the frame, a second foam panel disposed in a cavity defined by the frame, and a foam layer.

24 Claims, 16 Drawing Sheets

(56) References Cited

U.S. PATENT DOCUMENTS

| | | | | |
|---|---|---|---|---|
| 5,950,389 | A | 9/1999 | Porter | |
| 5,953,883 | A | 9/1999 | Ojala | |
| 5,979,131 | A | 11/1999 | Remmele et al. | |
| 6,085,479 | A | 7/2000 | Carver | |
| 6,205,729 | B1 | 3/2001 | Porter | |
| 6,308,491 | B1 | 10/2001 | Porter | |
| 6,332,304 | B1 | 12/2001 | Fuhrman | |
| 6,408,594 | B1 | 6/2002 | Porter | |
| 6,438,915 | B1 | 8/2002 | Beauboeuf | |
| 6,481,172 | B1 | 11/2002 | Porter | |
| 6,854,218 | B2 | 2/2005 | Weiss | |
| 7,127,858 | B2 | 10/2006 | Layfield | |
| 7,168,216 | B2 | 1/2007 | Hagen, Jr. | |
| 8,033,065 | B2 | 10/2011 | Paetkau et al. | |
| 8,065,846 | B2 | 11/2011 | McDonald et al. | |
| 8,365,497 | B2 * | 2/2013 | Rothwell | E04C 2/386 156/71 |
| 8,397,465 | B2 | 3/2013 | Hansbro et al. | |
| 8,458,983 | B2 | 6/2013 | Propst | |
| 8,635,778 | B1 | 1/2014 | Hagaman | |
| 8,844,243 | B1 | 9/2014 | Gillman | |
| 8,875,472 | B2 * | 11/2014 | Korwin-Edson | C08F 265/04 52/309.4 |
| 8,925,270 | B2 | 1/2015 | Grisolia et al. | |
| 8,959,862 | B1 | 2/2015 | Kreizinger | |
| 9,523,195 | B2 * | 12/2016 | Nandi | E04B 2/38 |
| 2004/0016194 | A1 | 1/2004 | Stefanutti et al. | |
| 2010/0011701 | A1 | 1/2010 | Cole et al. | |
| 2011/0115991 | A1 * | 5/2011 | Sawaki | G02B 5/1861 349/5 |
| 2012/0011792 | A1 * | 1/2012 | DeWildt | E04C 2/386 52/309.4 |
| 2012/0096785 | A1 | 4/2012 | Weeks | |
| 2012/0240501 | A1 | 9/2012 | Spiegel | |
| 2013/0104480 | A1 | 5/2013 | Smith | |
| 2013/0305643 | A1 | 11/2013 | Singleton et al. | |
| 2013/0312350 | A1 | 11/2013 | Kreizinger | |
| 2014/0115991 | A1 | 5/2014 | Sievers et al. | |
| 2014/0265027 | A1 | 9/2014 | Kreizinger | |
| 2015/0093535 | A1 * | 4/2015 | Lambach | E04C 2/386 428/71 |

OTHER PUBLICATIONS

Grisolia, Anthony et al; U.S. Appl. No. 14/816,668; Title: Stucco Wall Structure; Assigned to: Covestro LLC; filed Aug. 3, 2015.

* cited by examiner

FOAM WALL STRUCTURES AND METHODS FOR THE MANUFACTURE THEREOF

FIELD

The present invention relates to foam wall structures and methods for making such structures in which a foam layer is located within a cavity formed by frame members and a first foam panel, wherein a second foam panel is disposed within the cavity.

BACKGROUND

Insulated wall panels provide thermal insulation for residential homes and buildings. A wall panel's R-value reflects its ability to impede heat flow. The greater the ability to impede heat flow, the higher the R-value. Over the years, insulation standards have become stricter, requiring higher R-values and continuous insulation on the exterior side of insulated walls. The current market solutions to these stricter requirements are typically (1) pre-fabricated wall panels that incorporate insulation at the construction site, and (2) Structural Insulated Panels (SIPs).

The pre-fabricated wall panel that incorporates insulation at the construction site is the more widely adopted solution in the market. However, this solution requires a separate sub-contractor for on-site installation with fiberglass batting, which is known to have suboptimal R-values. Fiberglass is not an air barrier and allows for air intrusion, thus increasing the probability of condensation and mold growth within wall systems. Furthermore, additional material is necessary to finish the wall (e.g., Oriented Strand Panels (OSBs) and house wrap) and the overall construction process duration is extended, thereby increasing the risk of trade scheduling conflicts. Installing insulation onsite also leads to potential inconsistencies in insulation installation, performance, and usage.

The second solution, SIPs, also have several drawbacks. SIPs typically utilize expanded polystyrene (EPS) foam insulation sandwiched between two OSB panels, which only provide thermal performance of about R-4 per inch. Additionally, current SIPs are mainly used by smaller scale home builders with high levels of home customization.

More recently, insulated wall structures satisfying the strict industry insulation requirements that can be made without excessive material and labor costs have been proposed. According to one proposal, a foam wall structure includes a polyiso panel attached to at least a portion of a front frame surface, such that the polyiso panel and frame members define one or more voids within the frame; and a foam layer received within at least a portion of one of the voids within the frame, wherein the foam layer adheres to at least a portion of the polyiso panel.

While such foam wall structures can provide many benefits, it would be desirable to provide foam wall structures that satisfy the strict industry insulation requirements, that have sufficient structural strength, that can be made without excessive material and labor costs, that utilize a reduced amount of foam layer material, that create a smooth interior surface and/or reduce the amount of waste foam panels resulting from the production of foam wall structures, such as waste foam panel produced during creation of door and/or window cut-outs in the wall structure.

The present invention has been made in view of the foregoing desire.

SUMMARY

In certain respects, the specification relates to wall structures and methods of manufacturing wall structures. These wall structures comprise: a frame comprising: a first member; a second member spaced apart from the first member; and connecting members extending between the first member and the second member, wherein the first member, the second member, and the connecting members each comprise a front surface and a rear surface that form a front frame surface and a rear frame surface; a first foam panel attached to the front frame surface, wherein: (i) the first foam panel overlies the front frame surface, and (ii) the first foam panel, the first and second members, and the connecting members define a cavity within the frame; a second foam panel disposed within the cavity and having a front surface facing the first foam panel and a rear surface facing away from the first foam panel; and a foam layer located within the cavity, wherein the foam layer adheres to the first foam panel and the second foam panel, and wherein the foam layer covers at least a portion of the rear surface of the second foam panel.

BRIEF DESCRIPTION OF THE DRAWINGS

Various features and characteristics of the inventions described in this specification may be better understood by reference to the accompanying figures, in which.

The reader will appreciate the foregoing features and characteristics, as well as others, upon considering the following detailed description of the inventions according to this specification.

DETAILED DESCRIPTION

As used in this specification, the term "front" refers to the side, face, or surface of a structure or component oriented towards the outside direction of an exterior wall of a building, and the term "rear" refers to the side, face, or surface of a structure or component oriented towards the inside direction of an exterior wall of a building.

Figure 1:
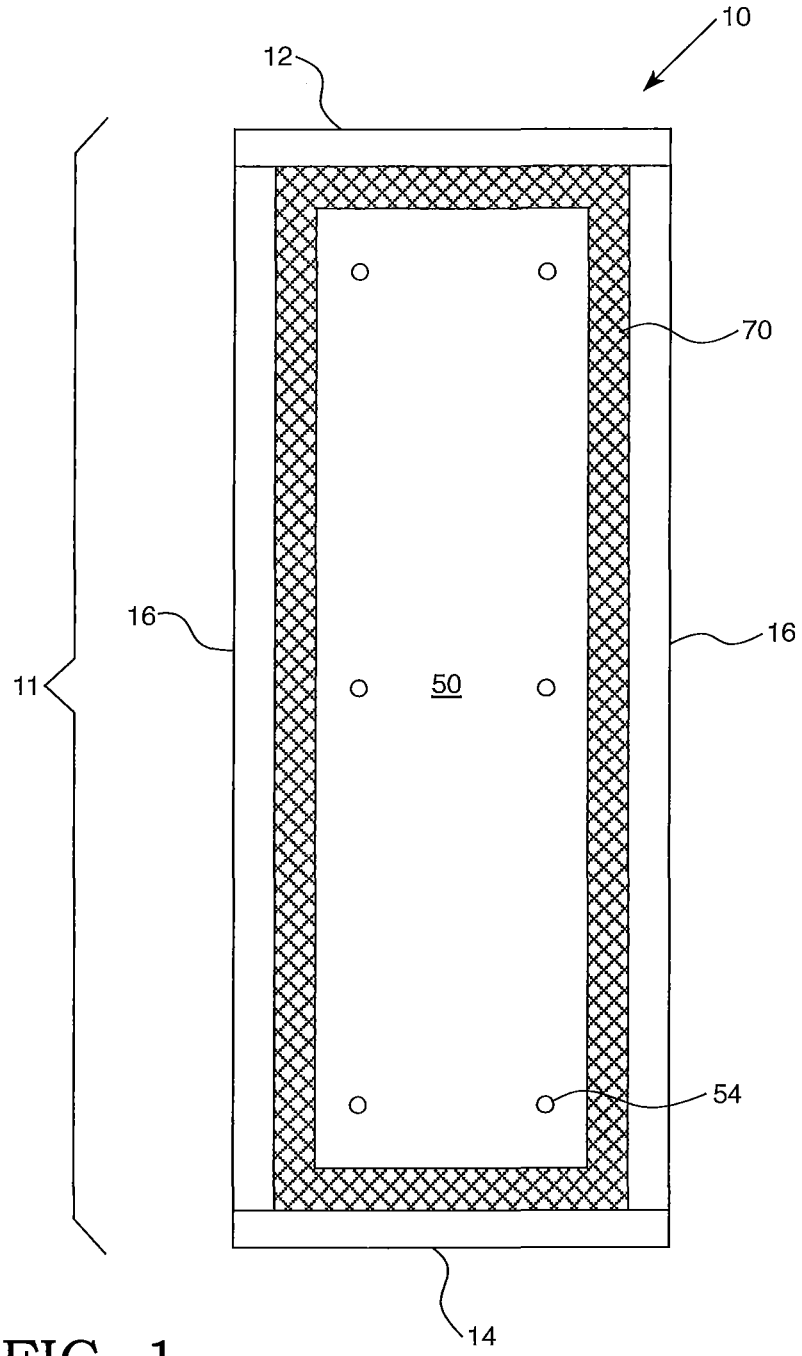
FIG. 1 is a rear view of a wall structure comprising a frame, a first foam panel attached to the frame, and a second foam panel positioned within a cavity.
Figure 2:
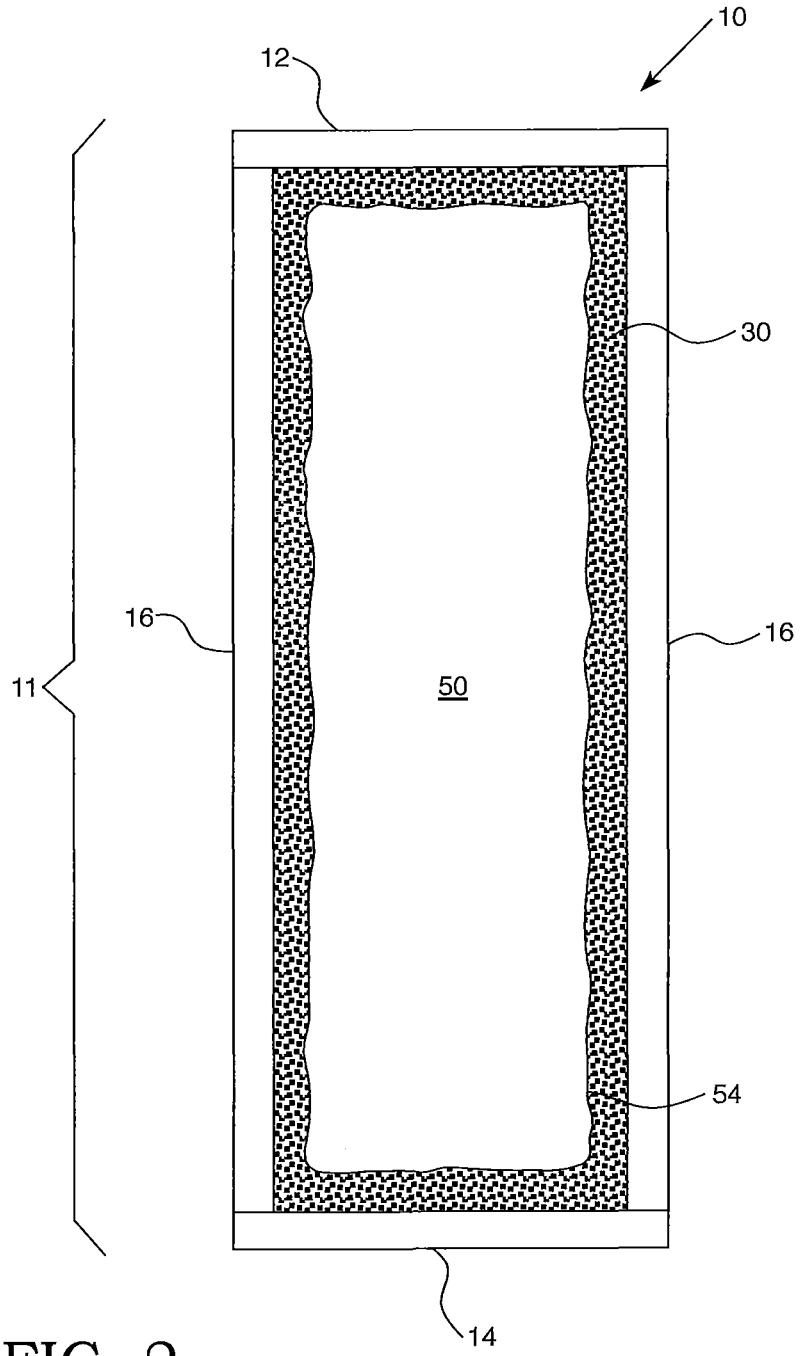
FIG. 2 is a rear view of the wall structure shown in FIG. 1 after deposition of a foam layer.
Figure 3:
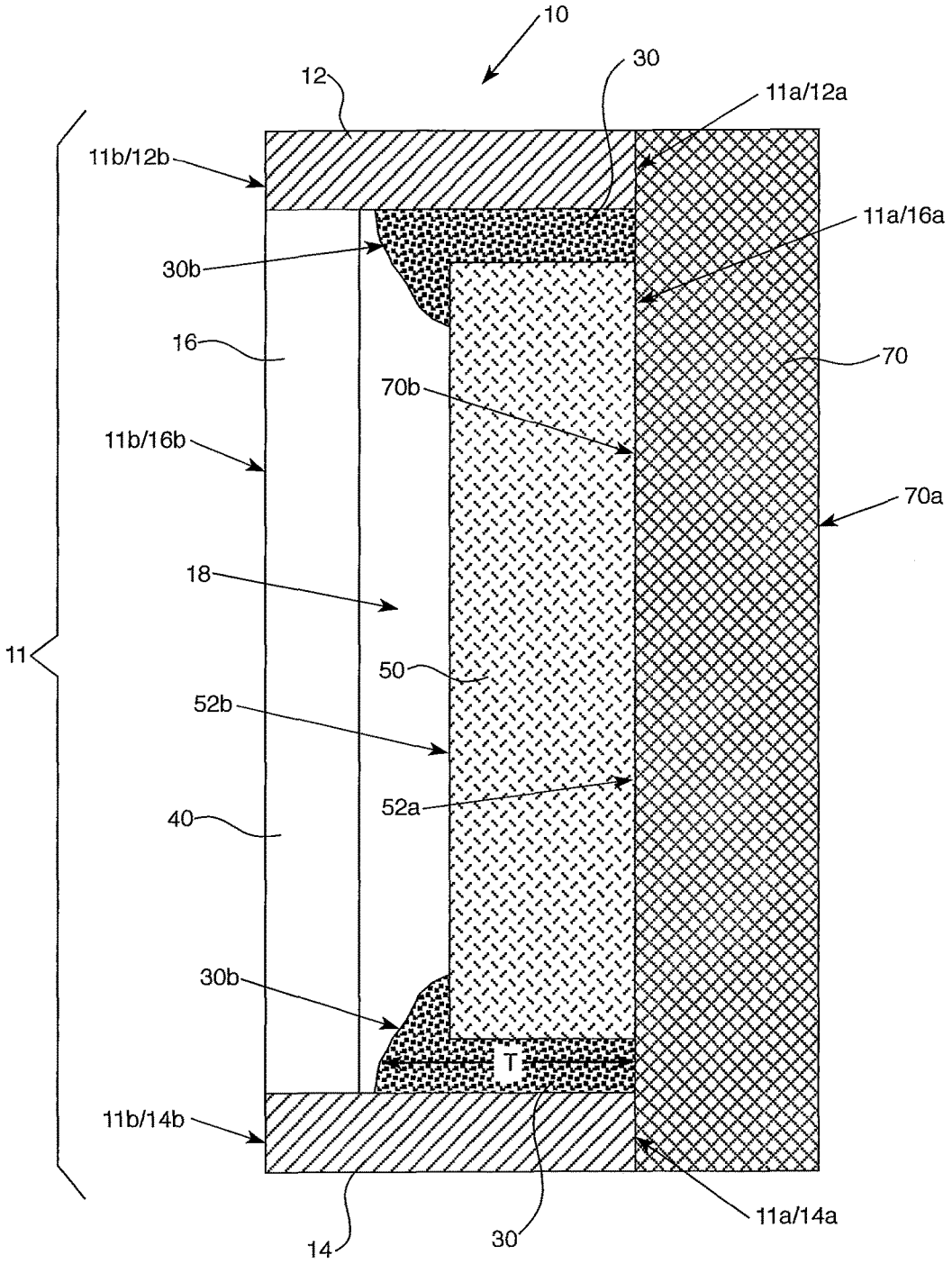
FIG. 3 is a side cross-sectional schematic diagram of the wall structure shown in FIG. 2.

Referring to FIGS. 1-3, a wall structure 10 comprises frame 11. The frame 11 comprises a first member 12, a second member 14 spaced apart from the first member 12, and connecting members (such as two side members) 16 extending between the first member 12 and the second member 14. As used herein, the term "connecting member" refers to a member that connects first member 12 with second member 14 and includes side members 16 and primary support members 17 (which are described in more detail below). The first member 12, the second member 14, and the connecting members 16 each comprise a front surface (12*a*, 14*a*, and 16*a*, respectively) and a rear surface (12*b*, 14*b*, and 16*b*, respectively) that collectively form a front frame surface 11*a* and a rear frame surface 11*b*. The constituent members (12, 14, and 16) of the frame 11 can be made out of a suitable material of construction such as wood. For example, the constituent members (12, 14, and 16) of the frame 11 can comprise wooden 2×4 members (i.e., structural members made of wood having nominal thicknesses of about 2-inches, nominal widths of about 4-inches, and suitable lengths) secured together with fasteners such as nails, nail plates, screws, staples, bolts, or rivets, or a combination of any thereof.

A first foam panel 70 may be attached to the front frame surface 11*a* so that the first foam panel overlies the front frame surface. As used in this specification, the term "foam panel" refers to panels comprising foam, such as, for example, polyisocyanurate (sometimes referred to as "polyiso") foam panels, expanded polystyrene foam panels, and extruded polystyrene foam panels. As will be appreciated, such foam panels have relatively low fastener pull-out strength as compared to wood panels, plywood panels, and OSBs. Accordingly, "foam panel" as used in this specification, is to be distinguished from wood panels, plywood panels, and OSBs, for example. As used herein, "foam" refers to a substance that is formed by trapping pockets of gas in a liquid or solid. In certain embodiments, the foams described in this specification are "closed-cell" foams. The term "closed-cell foam", as used in this specification, means that the foam has a closed cell content of at least 80%, sometimes at least 90%, when measured according to ASTM D6226-15, which is incorporated herein by reference. In certain embodiments, the foams described in this specification are "rigid" foams. The term "rigid foam" refers to a foam having a ratio of compressive strength to tensile strength of at least 0.5:1, elongation of less than 10%, and a low recovery rate from distortion and a low elastic limit, as described in "Polyurethanes: Chemistry and Technology, Part II Technology," J. H. Saunders & K. C. Frisch, Interscience Publishers, 1964, page 239, which is incorporated herein by reference. The term "panel", as used in this specification, refers to a solid, relatively thin and flat slab of material, which in some cases, has a rectangular or square shape. In some embodiments, the foam panels described herein have a thickness of no more than 2 inches (5.08 cm), such as a thickness of 1 to 2 inches (2.54 to 5.08 cm) or 1 to 1.5 inches (2.54 cm to 3.81 cm).

Figure 4:
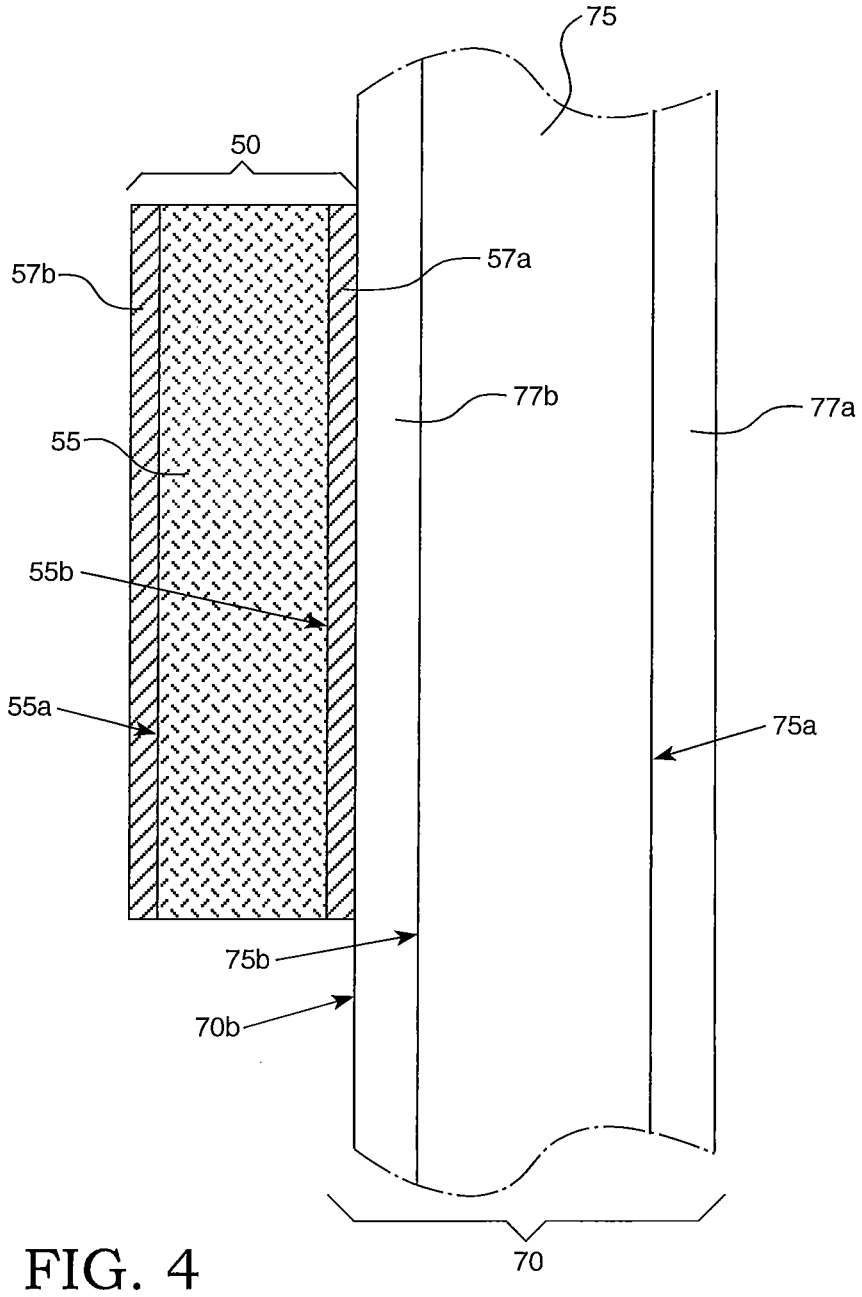
FIG. 4 is a side cross-sectional schematic diagram of a second foam panel comprising a foam layer and a facer material attached to a front face and a rear face of the foam layer that is positioned on a first foam panel comprising a foam layer and a facer material attached to a front face and a rear face of the foam layer.

The first foam panel 70 attached to the front frame surface 11*a* can comprise a facer material on the rear face and/or the front face of the foam. For example, referring to FIG. 4, the first foam panel 70 may comprise a polyiso panel comprising a polyisocyanurate foam layer 75 and a facer material 77*a*/77*b* attached to a front face 75*a* and/or a rear face 75*b* of the polyisocyanurate foam layer 75. Although FIG. 4 shows facer materials 77*a* and 77*b* respectively attached to both the front face 75*a* and the rear face 75*b* of the polyisocyanurate foam layer 75, it is understood that a polyiso panel or other type of foam panel can comprise a facer material attached to just one face, either the front face or the rear face, of a polyisocyanurate foam layer or other core foam layer (e.g., expanded polystyrene or extruded polystyrene).

Polyiso panels and other types of foam panels generally comprise a facer material attached to and substantially covering both sides (the front and rear faces) of a polyisocyanurate foam layer or other core layer. For example, facer materials can comprise glass mats filled with recycled cardpanel and colored with carbon black. Facer materials can also comprise foil or foil/glass composites. Facer materials can also comprise fibrous materials such as fiberglass materials or other fiber-reinforced sheet-like materials. Examples of suitable facer materials include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.). If a polyiso panel or other type of foam panel comprises facer materials on both the front and rear faces of the polyisocyanurate foam layer or other core layer, then the facer material on the front face may be the same as or may be different than the facer material on the rear face. The facer material should meet the requirements as described in ASTM D226/D226M-09: Standard Specification for Asphalt-Saturated Organic Felt Used in Roofing and Waterproofing; or ASTM E2556/E2556M-10: Standard Specification for Vapor Permeable Flexible Sheet Water-Resistive Barriers Intended for Mechanical Attachment; or otherwise qualify as a water-resistive barrier in accordance with International Residential Code (IRC) 703.2 (2012), which are each incorporated by reference into this specification. For embodiments in which the first foam panel comprises a polyiso panel, the foam panel may meet the requirements of ASTM C1289-15: Standard Specification for Faced Rigid Cellular Polyisocyanurate Thermal Insulation Panel, which is incorporated by reference into this specification.

Referring again to FIGS. 1-3, the first foam panel 70 may be attached to the front frame surface 11*a*. The first foam panel 70 can be attached to any of the front faces (12*a*, 14*a*, and/or 16*a*) of the constituent members (12, 14, and 16) of the frame 11. For example, the first foam panel 70 can be attached to the front faces 12*a* and 14*a* of the first and second members 12 and 14 and to the front faces 16*a* of the connecting members 16 extending therebetween. The first foam panel 70 can be attached to the front frame surface 11*a* with fasteners and/or an adhesive (not shown). Attachment fasteners can include, but are not limited to, nails, staples, screws, bolts, or rivets, or a combination of any thereof. Attachment adhesives can comprise a construction adhesive that is compatible with the adjoining materials. For example, an adhesive used to attach a foam panel to a frame can comprise a foam material (which may be the same foam material or a different foam material as the foam material comprising the foam layer, described below).

The first foam panel 70, the first member 12, the second member 14, and the connecting members 16 define a cavity 18 within the frame 11. One or more second foam panel(s) 50 may be located within the cavity 18 and have a front surface 52*a* facing the first foam panel 70 and a rear surface 52*b* facing away from the first foam panel 70. In some cases, the front surface 52*a* of the second foam panel 50 is attached directly to the rear surface 70*b* of the first foam panel 70. As used herein, the phrase "attached directly" means that the second foam panel 50 is attached to the first foam panel 70 such that there are no materials between the front surface 52*a* of the second foam panel 50 and at least a portion of the rear surface 70*b* of the first foam panel 70. In some embodiments, no foam panel is in contact with the rear surface 52*b* of the second foam panel(s) 50.

Referring to FIGS. 2 and 3, a foam layer 30 may be located within the cavity 18. The foam layer 30 adheres to the first foam panel 70 and the second foam panel 50 and covers at least a portion of the rear surface 52*b* of the second foam panel 50.

The foam layer 30 may, but does not necessarily, completely encapsulate the second foam panel 50 within the cavity 18. For example, as shown in FIGS. 2 and 3, in some embodiments the foam layer is located in the cavity 18 in gaps between: (a) the second foam panel 50, and (b) the first member 12, the second member 14 and/or the connecting members 16. In some of these embodiments, at least a portion of the rear surface 52*b* of the second foam panel 50 is not covered by the foam layer 30. For example, in some cases, at least 10%, such as at least 30%, at least 50%, at least 70%, or, in some cases, at least 90% of the surface area of the rear surface 52*b* of the second foam panel 50 is not covered by the foam layer 30.

In some embodiments, the second foam panel 50 is not attached to the first foam panel 70 but is held in contact with the rear surface 70*b* of the first foam panel 70 solely by the foam layer 30. In some embodiments, the second foam panel 50 may be attached to the first foam panel 70 with an adhesive. In some embodiments, the second foam panel 50 is not directly attached to the first member 12, the second member 14 or the connecting members 16.

In embodiments in which the second foam panel 50 is not attached to the first foam panel 70 with an adhesive, the second foam panel 50 can directly contact the rear surface 70*b* of the first foam panel 70, such as is illustrated in FIG. 3, for example. In cases where the second foam panel 50 is attached to the first foam panel 70 with an adhesive, the second foam panel 50 can indirectly contact the rear surface 70*b* of the first foam panel 70. The second foam panel 50 can be attached to the first foam panel 70 with a construction adhesive that is compatible with the adjoining materials, such as, but not limited to, a foam material (which may be the same foam material or a different foam material as the foam material comprising the foam layer).

Figure 5:
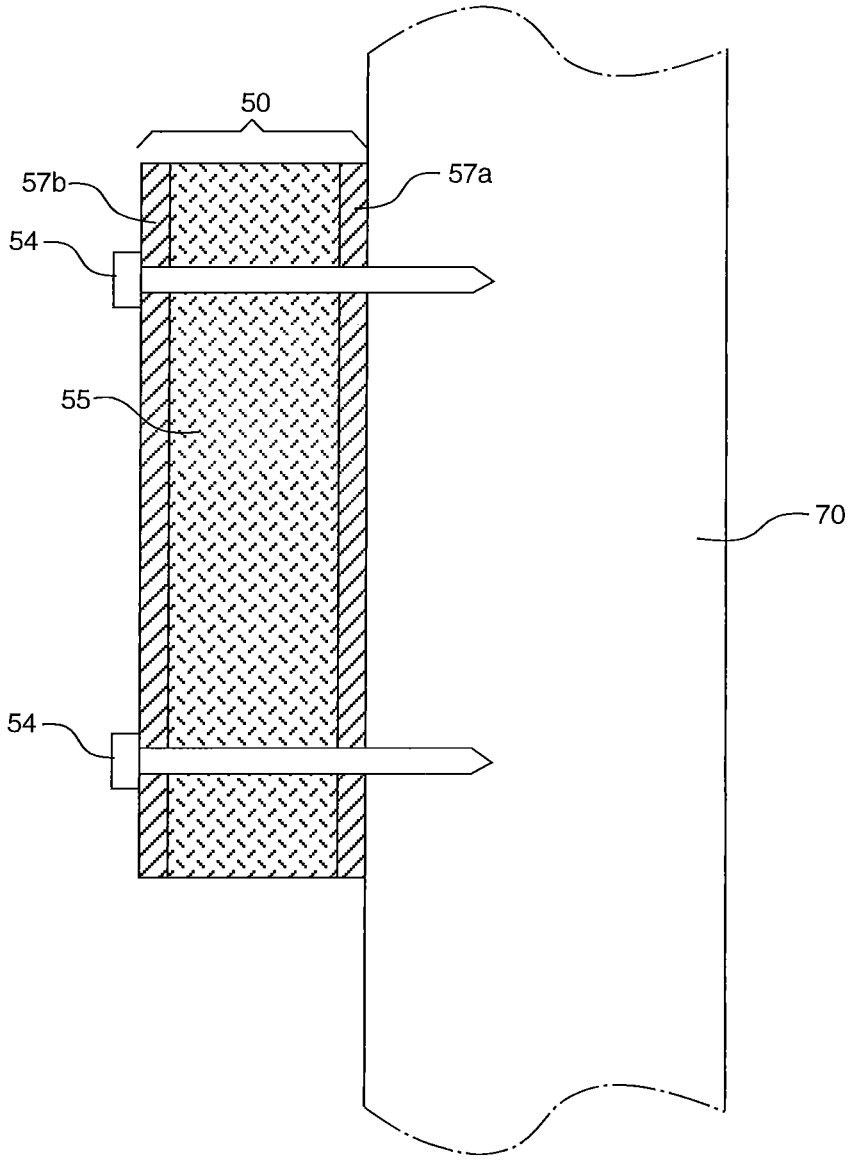
FIG. 5 is a side cross-sectional schematic diagram of a second foam panel positioned on a first foam panel with positioning devices.

In some embodiments, the second foam panel 50 can be positioned on the first foam panel 70 with one or more positioning devices 54, as illustrated in FIG. 1 and FIG. 5, for example. Referring to FIG. 5, the second foam panel 50 is shown positioned on the first foam panel 70 with positioning devices 54 located through the entire thickness of the second foam panel 50 and engaging the first foam panel 70, but not penetrating through the entire thickness of the first foam panel 70. The positioning devices 54 can aid in maintaining the location of the second foam panel 50 on the first foam panel 70 during the deposition of the foam layer 30. The positioning devices 54 can comprise one or more fasteners such as screws, nails, bolts, pins, or a combination of any thereof. It should be noted, however, that the optional positioning devices 54 do not function to provide significant mechanical attachment between the second foam panel 50 and the first foam panel 70 because of the relatively low fastener pull-out strength of the first foam panel 70 and the second foam panel 50. Rather, the optional positioning devices 54 function primarily to maintain placement during manufacture and the attachment of the second foam panel 50 to the first foam panel 70 is provided by the foam layer 30 and any optional adhesive between the second foam panel 50 and the first foam panel 70. As a result, in some embodiments, some or all of the optional positioning devices 54 are removed after deposition of foam layer 30.

As with the first foam panel 70, the second foam panel 50 can comprise, for example, polyiso foam panels, expanded polystyrene foam panels, and/or extruded polystyrene foam panels.

As with the first foam panel 70, the second foam panel 50 can comprise a facer material on the rear face and/or the front face of the foam. For example, referring to FIG. 4, the second foam panel 50 may comprise a polyiso panel comprising a polyisocyanurate foam layer 55 and a facer material 57*a*/57*b* attached to a front face 55*a* and/or a rear face 55*b* of the polyisocyanurate foam layer 55. Although FIG. 4 shows facer materials 57*a* and 57*b* respectively attached to both the front face 55*a* and the rear face 55*b* of the polyisocyanurate foam layer 55, it is understood that a polyiso panel or other type of foam panel can comprise a facer material attached to just one face, either the front face or the rear face, of a polyisocyanurate foam layer or other foam core layer (e.g., expanded polystyrene or extruded polystyrene).

In some embodiments, the second foam panel 50 is a polyiso panel or another type of foam panel comprising a facer material attached to and substantially covering both sides (the front and rear faces) of a polyisocyanurate foam layer or other foam layer. Suitable facer materials include any of those mentioned earlier with respect to the first foam panel 70, such as those comprising glass mats filled with recycled cardpanel and colored with carbon black, foil or foil/glass composites, fibrous materials, such as fiberglass materials or other fiber-reinforced sheet-like materials, specific examples of which include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.).

The foam layer 30 (and, optionally, any foam-based adhesive used to attach the first foam panel 70 to the frame 11, and/or attach the second foam panel 50 to the first foam panel 70) can comprise, for example, polyurethane, polyurea, or polyisocyanurate, or a mixture thereof. The foam layer 30 can be substantially free, essentially free, or completely free of halogen-containing flame retardant additives.

Examples of foam materials include, but are not limited to, foams made with polyurethane, polyurea, polyisocyanurate (also referred to as polyiso), and mixtures thereof. Foam materials (including the foam layer 30) may be substantially free, may be essentially free, or may be completely free of halogen-containing flame retardant additives. The term "halogen" refers to the halogen elements, which include fluorine, chlorine, bromine, and iodine, and the term "halogen-containing flame retardant additives" refers to a substance that may be used to inhibit or resist the spread of fire, and which contains halogen groups such as a fluoro, chloro, bromo, and/or iodo groups. Further, the term "substantially free," as used in this specification, means the foam material contains less than 1000 parts per million (ppm), "essentially free" means less than 100 ppm, and "completely free" means less than 20 parts per billion (ppb) of halogen-containing flame retardant additives.

Referring to FIG. 3, in some embodiments the foam layer 30 comprises a thickness T extending from the rear surface 70*b* of the first foam panel 70 to a position intermediate the front frame surface 11*a* and the rear frame surface 11*b*. In this manner, a gap 40 may be formed within the frame 11 between a rear surface 30*b* of the foam layer 30 and the rear frame surface 11*b*. Although FIG. 3 shows the foam layer 30 comprising a thickness T extending from the rear surface 70*b* of the first foam panel 70 to a position intermediate the front frame surface 11*a* and the rear frame surface 11*b*, it is understood that the foam layer 30 can alternatively comprise a thickness extending from the rear surface 70*b* of the first foam panel 70 to the rear frame surface 11*b*, in which case there may be no gap formed within the frame 11 between the rear surface 30*b* of the foam layer 30 and the rear frame surface 11*b*. In some embodiments, gap 40 has a width, from the rear surface of the foam layer 30*b* to the rear frame surface 11*b*, of at least 1 inch (2.54 cm), such as 1 to 2 inches (2.54 to 5.08 cm) or 1.5 to 2 inches (3.81 to 5.08 cm). In some embodiments, the foam layer 30 is disposed continuously along substantially the entire surface of first member 12, second member 14, and members 16 so as to, for example, be in the form of a "picture frame" within the cavity 18.

Figure 6:
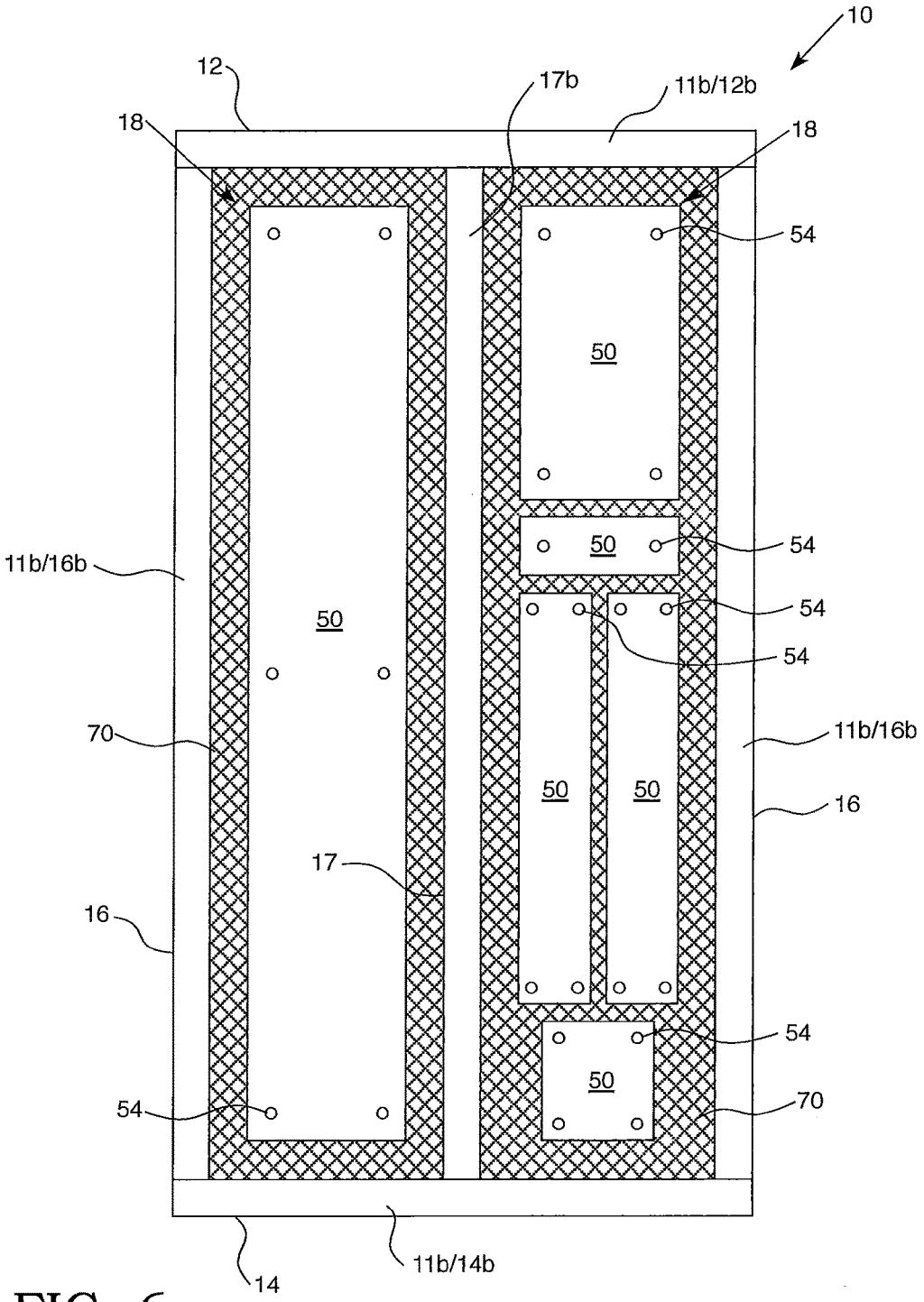
FIG. 6 is a rear view of a wall structure comprising a frame, a first foam panel attached to the frame, and a plurality of second foam panels positioned within cavities, prior to deposition of foam layers.
Figure 7:
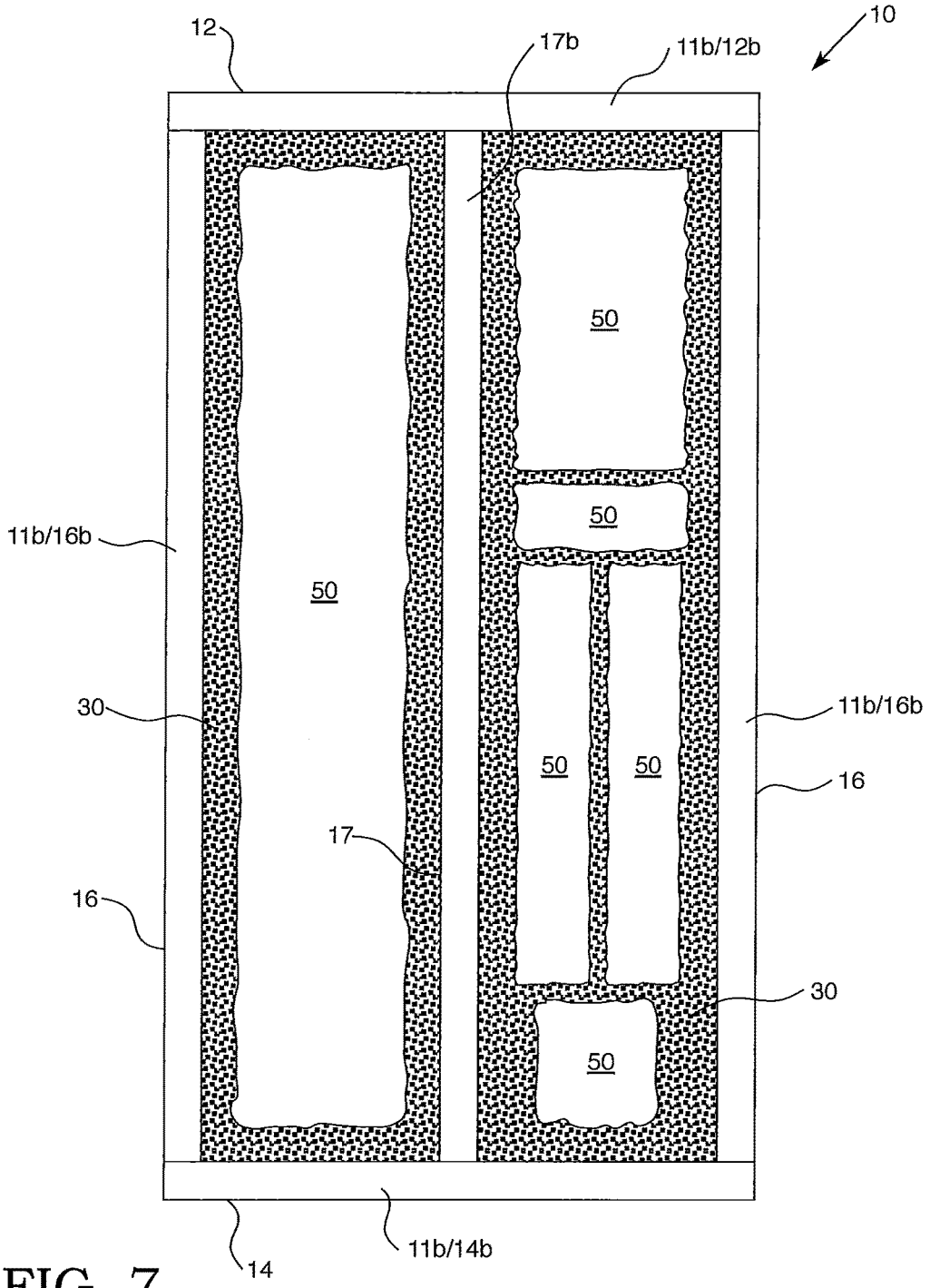
FIG. 7 is a rear view of the wall structure shown in FIG. 6 after deposition of foam layers.

Referring to FIGS. 6 and 7, for example, the wall structure 10 can comprise a plurality of second foam panels 50, such as 2, 3, 4 or more second foam panels 50. The second foam panels 50 can be of any size or configuration. As such, it may be convenient to utilize waste foam panels produced during creation of door and/or window cut-outs in the wall structure 10 (as described below) as one or more second foam panels 50. In some embodiments, however, the second foam panel 50 does not have beveled sides.

In certain embodiments, however, the second foam panel (s) 50 cover at least 10%, such as at least 30%, at least 50%, at least 70%, at least 75%, or, in some cases, at least 90% of the surface area of the cavity 18. Moreover, as described above and illustrated in FIGS. 2, 3, 7 and 8E, for example, the foam layer 30 may be located in the cavity 18 in gaps between: (a) the second foam panel(s) 50, and (b) the first member 12, the second member 14 and/or the connecting members 16 such that, in some embodiments, at least a portion of the rear surface 52*b* of the second foam panel(s) 50 are not covered by the foam layer 30. In some cases, at least 10%, such as at least 30%, at least 50%, at least 70%, or, in some cases, at least 90% of the surface area of the rear surface 52*b* of the second foam panel(s) 50 are not covered by the foam layer 30. As such, the wall structure 11 can utilize a significantly reduced amount of foam layer material and have a smoother interior surface (due to the exposed rear surface(s) 52*b* of second foam panel(s) 50), as compared to similar wall structures that lack the second foam panel(s) as described herein and in which a continuous foam layer 30 fills the entire surface area of cavity 18. Moreover, the wall structure 11 can still satisfy the strict industry insulation requirements and can have at least similar structural strength as compared to similar wall structures that lack the second foam panel(s) 50 as described herein and in which a continuous foam layer 30 fills the entire surface area of cavity 18.

Referring to FIGS. 1 and 6, for example, the second foam panel(s) 50 are shown as rectangular-shaped panels with gaps between the horizontal and vertical edges of the second foam panel(s) 50 and the first member 12, the second member 14 and the members 16. However, it is to be understood that the shape and dimensions of the second foam panel(s) 50, and their location relative to the members 16, the first member 12, and second member 14, or any other constituent members of the frame 11, are only limited by the shape and size of the cavity 18 in which the second foam panel(s) 50 are positioned. In some embodiments, however, one or more second foam panels 50 may be used in which a gap of at least 1 inch (2.54 cm), such as at least 1.5 inch (3.81 cm), or at least 2 inches (5.08 cm), exists between the horizontal and/or vertical edges of the one or more second foam panel(s) 50 and the first member 12, the second member 14, and/or the members 16.

For example, referring to FIGS. 6 and 7, a frame is shown comprising a first member 12, a second member 14 spaced apart from the first member 12, connecting members 16 extending between the first member 12 and the second member 14, and a primary support member 17 positioned between the connecting members 16 and extending between the first member 12 and the second member 14. The first member 12, the second member 14, and the connecting members 16 each comprise a front surface (not shown) and a rear surface (12*b*, 14*b*, and 16*b*, respectively) that collectively form the front frame surface (not shown) and the rear frame surface 11*b*. The primary support member 17 comprises a front primary support surface (not shown) and an opposite rear primary support surface 17*b*. The front primary support surface corresponds to the front frame surface. The rear primary support surface 17*b* corresponds to the rear frame surface 11*b*.

Figure 8A:
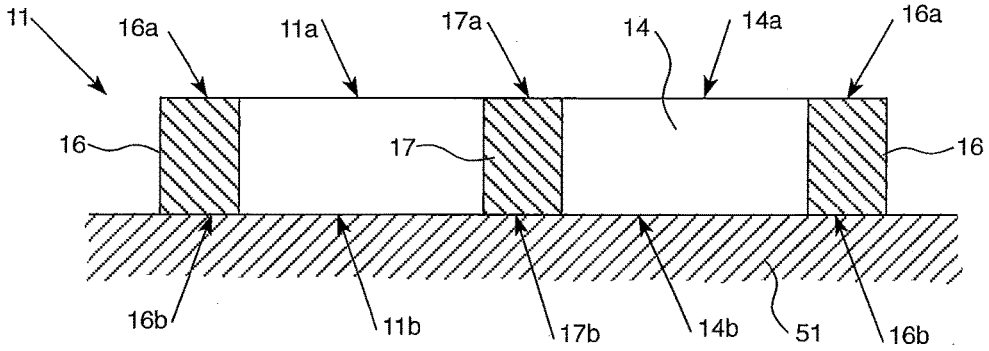
FIGS. 8A-8E are a series of cross-sectional schematic diagrams illustrating the manufacture of a wall structure as shown in FIG. 7.
Figure 8B:
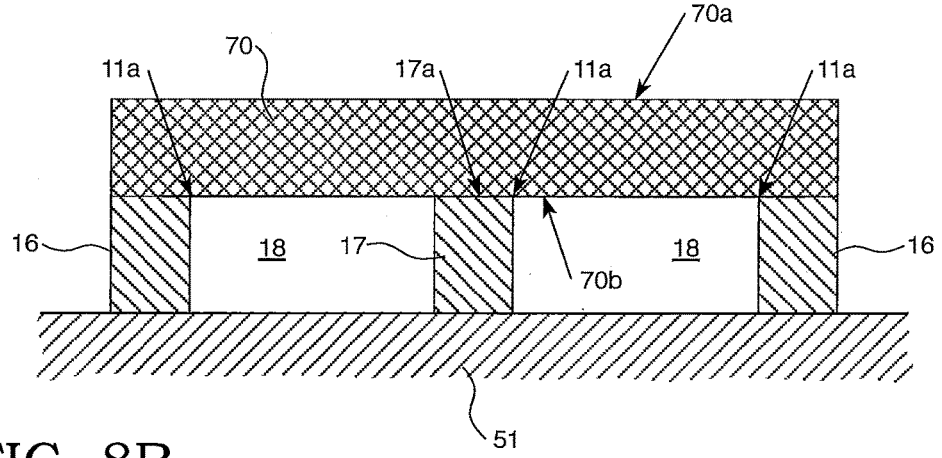
Figure 8C:
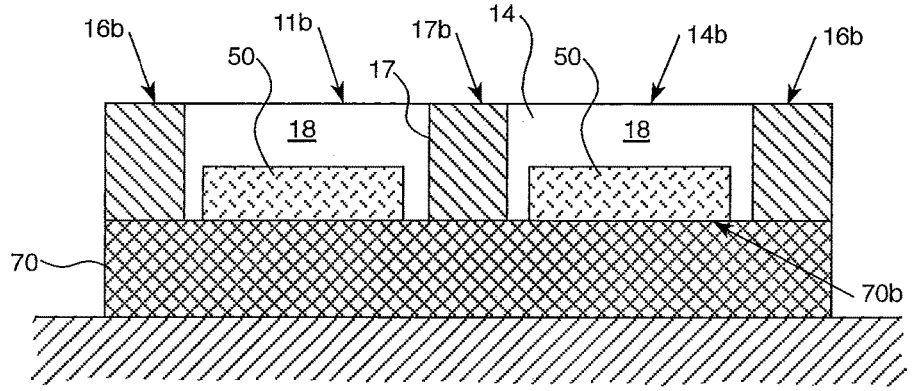
Figure 8D:
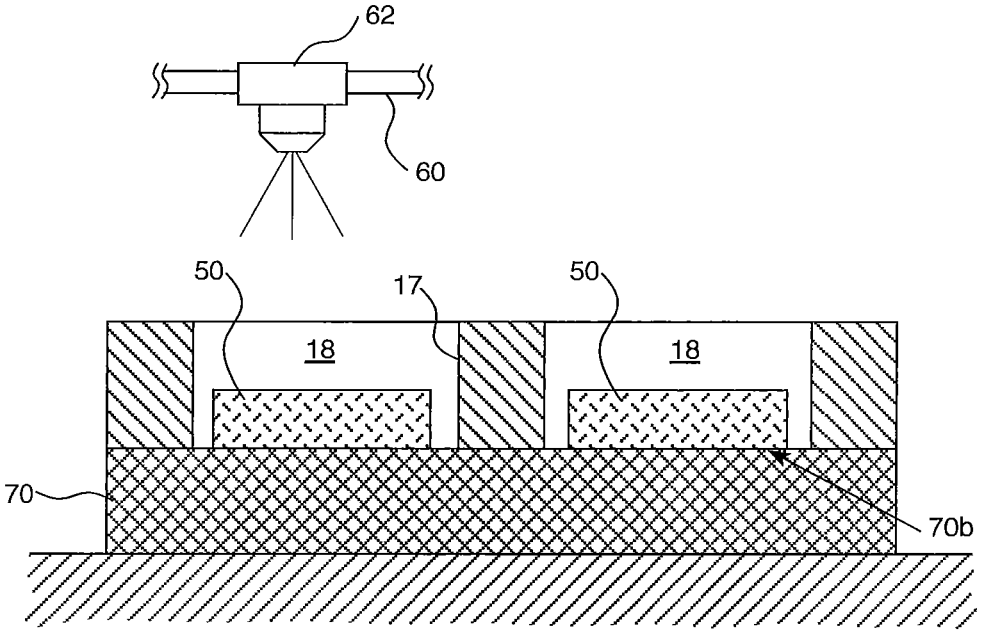
Figure 8E:
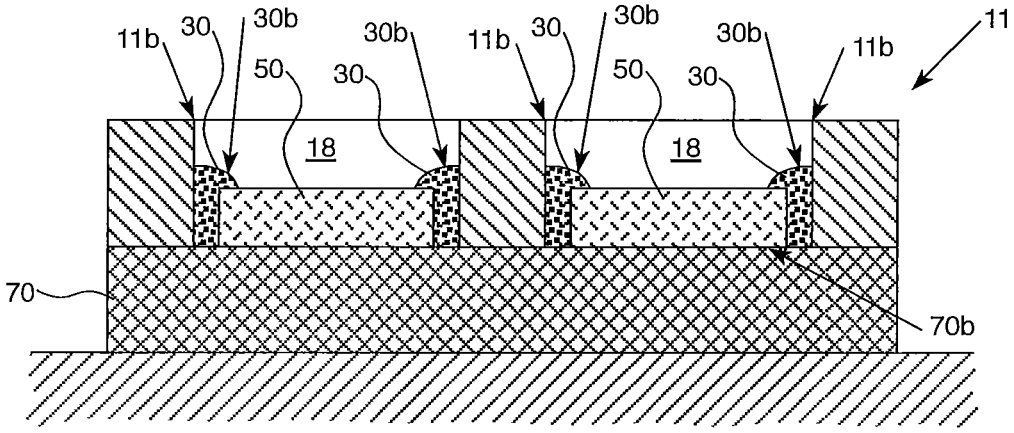

As illustrated in FIGS. 6 and 8B, for example, a first foam panel 70 may be attached to the front frame surface 11*a* and the front primary support surface (not shown in FIG. 6) so that the first foam panel 70 overlies the front frame surface 11*a*. The first foam panel 70, the first member 12, the second member 14, the members 16, and the primary support member 17 define cavities 18 within the frame. One or more second foam panels 50 may be located within one or more cavities 18 and may be in contact with the rear-facing surface 70*b* of the first foam panel 70. As illustrated in FIGS. 7 and 8D-8E, for example, a foam layer may be located within the cavity 18, adhered to the second foam panel(s) 50 and to the first foam panel 70 and covering at least a portion of the rear surface 70*b* of the first foam panel 70. The second foam panels 50 are shown in FIG. 6 such that some panels have dimensions such that the horizontal edges of the panels 50 are slightly shorter (such as no more than 4 inches shorter) than the width of the cavity (the distance between the primary support member 17 and the member 16 in FIG. 6), i.e., panels 50 substantially spans the distance between the primary support member 17 and the member 16. Another second foam panel 50 may have dimensions such that the horizontal edges of the panels are significantly shorter (such as more than 4 inches shorter) than the distance between the primary support member 17 and the member 16. Similarly, as shown in FIG. 6 some second foam panels 50 have dimensions such that the vertical edges of the panels 50 are slightly shorter (such as no more than 4 inches shorter) than the distance between the first member 12 and the second member 14 i.e., panels 50 substantially spans the distance between the first member 12 and the second member 14. Another second foam panel 50 may have dimensions such that the vertical edges of the panels are significantly shorter (such as more than 4 inches shorter) than the distance between the first member 12 and the second member 14.

The shape and dimensions of a second foam panel 50, and the location of a second foam panel 50 within a cavity 18 formed by a frame 11 and an attached first foam panel 70, can be selected based on the size of the cavity 18, the size of available foam panels, the amount of foam layer 30 desired, among other considerations.

Referring to FIGS. 8A-8E, a method of manufacturing a wall structure comprises providing a frame 11 as shown in FIG. 8A. The frame 11 comprises a first member (not shown), a second member 14 spaced apart from the first member, connecting members 16 extending between the first member and the second member 14, and a primary support member 17 positioned between the connecting members 16 and extending between the first member and the second member 14. The first member (not shown), the second member 14, the connecting members 16, and the primary support member 17 each comprise a front surface (14*a*, 16*a*, and 17*a*, respectively) and a rear surface (14*b*, 16*b*, and 17*b*, respectively) that collectively form the front frame surface 11*a* and the rear frame surface 11*b*. The frame 11 may be provided on a rigid support surface 51 so that the rear frame surface 11*b* (i.e., the rear surfaces 14*b*, 16*b*, and 17*b* of the second member 14, the connecting members 16, and the primary support member 17, respectively) contact the rigid support surface 51.

As shown in FIG. 8B, a first foam panel 70 may be attached to the front frame surface 11*a*. The first foam panel 70 may comprise a construction as described above. As also described above, the first foam panel 70 may be attached to front frame surface 11*a* (including any of the front faces of the first and second members, the front faces of the connecting members 16, and the front face of the primary support member) with fasteners (not shown). The fasteners may comprise nails, staples, screws, bolts, or rivets, or a combination of any thereof. Alternatively, or in addition, the first foam panel 70 may be attached to front frame surface 11*a* (including any of the front faces of the first and second members, the front faces of the connecting members 16, and the front face of the primary support member) with an adhesive (not shown). For example, a layer of foam may be deposited onto the rear-facing surface 70*b* of the first foam panel 70 before attaching the first foam panel 70 to the front frame surface 11*a*.

The first foam panel 70, the first member (not shown), the second member 14, the connecting members 16, and the primary support member 17 define cavities 18 within the frame 11. Although FIGS. 8A-8E show the frame 11 comprising the primary support member 17, which results in two cavities 18, it is understood that the primary support member 17 could be omitted from the frame 11, in which case a single cavity 18 within the frame 11 would be defined by the first member (not shown), the second member 14, and the connecting members 16 (see FIGS. 1-3). In addition, two or more primary support members may be included within a frame, thereby defining three or more cavities. Referring to FIG. 8C, the frame structure and the attached first foam panel 70 may be rotated 180 degrees through the horizontal plane so that the first foam panel 70 contacts the rigid support surface. One or more second foam panels 50 may be positioned within one or more, in some cases all, of the cavities 18 and may be in direct or indirect contact with the rear-facing surface 70*b* of the first foam panel 70.

The second foam panel 50 can be positioned within the cavity 18 as described above. For example, the positioning of the second foam panel 50 may not comprise attaching the second foam panel 50 to the first foam panel 70, and may comprise just physically positioning the second foam panel 50 on the rear surface 70*b* of the first foam panel 70, in which case the second foam panel 50 is held in place by gravity and friction. Alternatively, the positioning of the second foam panel 50 may comprise attaching the second foam panel 50 to the first foam panel 70 using an adhesive. For example, a layer of adhesive (such as foam) may be deposited onto the rear surface 70*b* of the first foam panel 70 before positioning the second foam panel 50 within the cavity 18 and in contact with the rear surface 70*b* of the first foam panel 70. Also, as described above, the second foam panel 50 can optionally be positioned on the first foam panel 70 using one or more positioning devices (not shown in FIG. 8C) that engage but do not penetrate through the first foam panel 70. If desired, such positioning devices can be removed after deposition of foam layer 30.

Referring to FIGS. 8D and 8E, a foam layer 30 may be deposited into the cavities 18. The foam may be deposited from a foam dispensing rig 60, which can include one or more nozzles 62 (however, it is understood that the foam can be deposited using any suitable operation such as, for example, manually using a foam spray gun). Referring to FIG. 8E, the deposited foam layer 30 may be located in the cavity 18 in gaps between: (a) the second foam panel 50, and (b) the first member 12, the second member 14 and/or the connecting members 16 such that at least a portion of the rear surface 52*b* of the second foam panel 50 is not covered by the foam layer 30. The foam layer 30 may be deposited to a thickness extending from the rear surface 70*b* of the first foam panel 70 to a position intermediate the front frame surface 11*a* and the rear frame surface 11*b* such that a gap 40 may be formed within the frame 11 between the rear surface 30*b* of the foam layer 30 and the rear frame surface 11*b*. It is understood, however, that the foam layer 30 can alternatively be deposited to a thickness extending from the rear surface 70*b* of the first foam panel 70 to the rear frame surface 11*b*, in which case no gap is formed within the frame 11 between the rear surface 30*b* of the foam layer 30 and the rear frame surface 11*b*. The deposited foam layer 30 can be cured so that the foam layer solidifies and adheres to the second foam panel 50 and the first foam panel 70.

Figure 10:
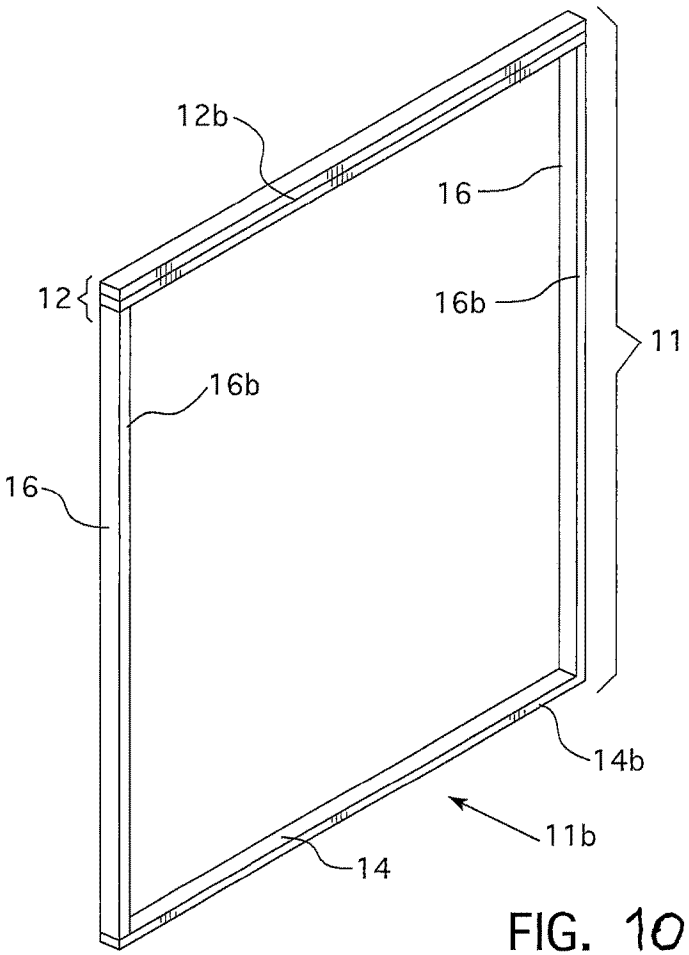
FIG. 10 is a rear perspective view of the wall structure frame shown in FIG. 9.
Figure 9:
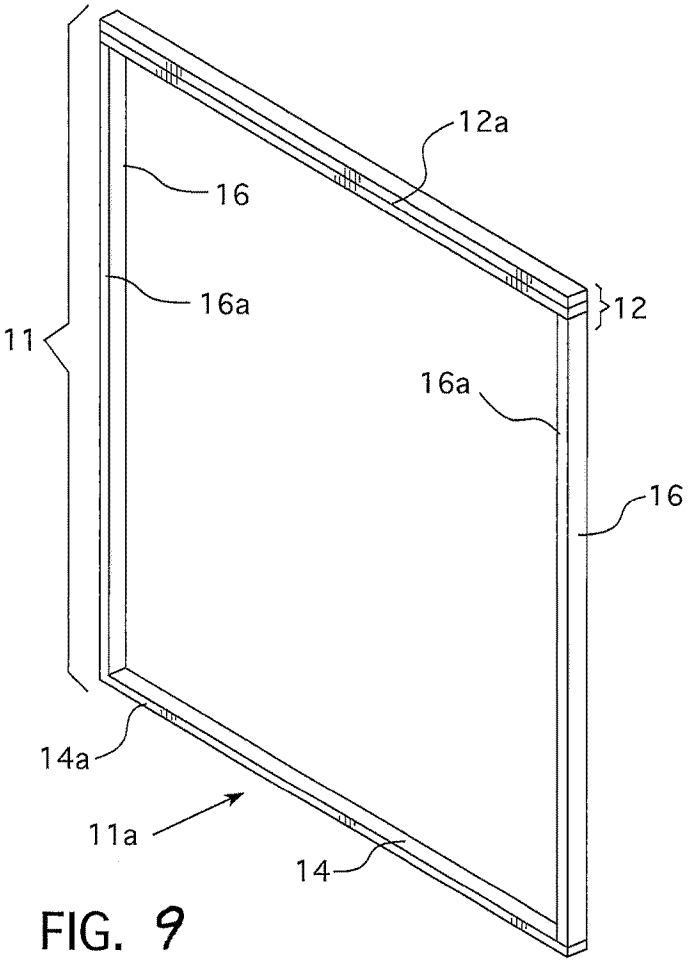
FIG. 9 is a front perspective view of a wall structure frame.

FIGS. 9-21 illustrate additional features of the wall structures and the methods of manufacturing the wall structures described in this specification. For example referring to FIGS. 11 and 12, a wall structure 10 includes a frame 11, at least one primary support member 17, a first foam panel 70, a foam layer 30, and a second foam panel (not shown in FIGS. 9-21). As shown in FIGS. 9 and 10, the frame 11 may be defined by a first member 12, a second member 14 spaced apart from the first member 12, and connecting members 16 extending between the first member 12 and the second member 14. The first member 12, the second member 14, and the connecting members 16 each have a front surface 12*a*, 14*a*, 16*a* and a rear surface 12*b*, 14*b*, 16*b* that define a front frame surface 11*a* and a rear frame surface 11*b*, respectively.

The frame 11 can be constructed into different shapes depending on its intended use. For example, as shown in FIGS. 9 and 10, the frame 11 can be constructed as a conventional industry standard rectangular or square frame 11. The first member 12 and the second member 14 may be spaced apart and extend parallel to each other, and the connecting members 16 may extend perpendicular to the first member 12 and the second member 14 so as to form a rectangular or square frame 11. The shape and design of the frame 11 is not so limited and can be constructed into any desired shape. Generally, the shape and design of the frame 11 is constructed in accordance with the floor plans designed for a particular home or building.

Figure 12:
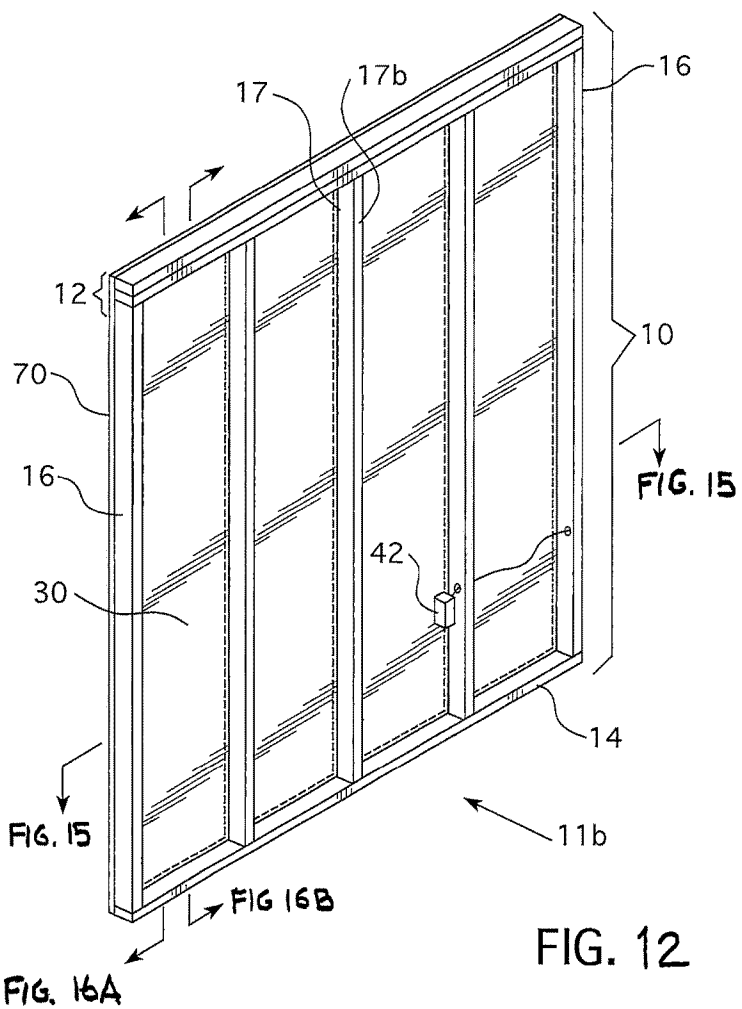
FIG. 12 is rear perspective view of the wall structure shown in FIG. 11.
Figure 11:
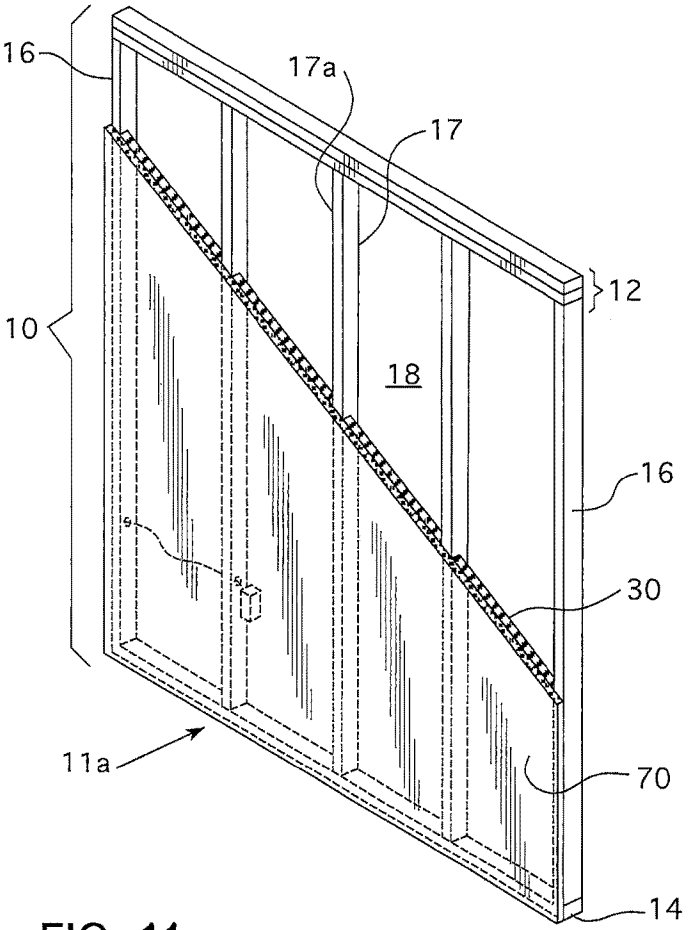
FIG. 11 is a front perspective view of a wall structure comprising a foam panel and a foam layer shown in partial cut-away.

Referring to FIGS. 11 and 12, at least one primary support member 17 may be positioned between the connecting members 16. The primary support members 17 may extend between the first member 12 and the second member 14. The primary support members 17 may define a front primary support surface 17*a* and a rear primary support surface 17*b*. As shown in FIGS. 11 and 12, the front primary support surface 17*a* and the rear primary support surface 17*b* correspond to the front frame surface 11*a* and the rear frame surface 11*b* of the frame 11. The primary support members 17 may be spaced apart to form cavities 18. The cavities 18 may be defined by the space formed within the frame 11 between the primary support members 17, the members 16, the first member 12, and/or the second member 14. The size of each cavity 18 can vary based on the size of the frame 11, the distance between consecutively positioned primary support members 17, and the number of primary support members 17 present. The primary support members 17, the members 16, the first member 12, and/or the second member 14 may comprise one or more plates, panels, beams, studs, or the like. For example, as shown in FIGS. 9-12, the first member 12 may include two beams.

The connecting members 16 and/or the primary support members 17 may be fixedly engaged to the first member 12 and the second member 14. For example, the connecting members 16 and/or the primary support members 17 may be fixedly engaged to the first member 12 and the second member 14 with fasteners. Suitable fasteners include, but are not limited to, nails, nail plates, staples, bolts, screws, and rivets. The first member 12, the second member 14, the connecting members 16, and the primary support members 17 can be made of various materials. For example, the first member 12, the second member 14, the connecting members 16, and the primary support members 17 can be made of wood, metal, fiberglass, plastic, wood-polymer composite materials, or a combination of any thereof. The first member 12, the second member 14, the connecting members 16, and the primary support members 17 can be made of the same material or different materials.

The dimensions of the first member 12, the second member 14, the connecting members 16, and the primary support members 17 can vary depending on the intended use of the frame 11. The first member 12, the second member 14, the connecting members 16, and the primary support members 17 can each have any dimension. The first member 12, the second member 14, the connecting members 16, and the primary support members 17 can have the same dimensions. For example, the first member 12, the second member 14, the connecting members 16, and the primary support members 17 may have the same thickness and width dimensions, and the same or different length dimensions. For example, the first member 12, the second member 14, the connecting members 16, and the primary support members 17 can all have a thickness and width and height dimension of nominally 2×4 inches. In another example, the first member 12, the second member 14, the connecting members 16, and the primary support members 17 can all have thickness and width dimensions of nominally 2×6 inches.

The first member 12, the second member 14, and the connecting members 16 can have the same dimensions, which may be different than the dimensions of the primary support members 17. For example, the first member 12, the second member 14, and the connecting members 16 may have the same thickness and width dimensions, and the primary support members 17 may have thickness and/or width dimensions that may be different than the dimensions of the first member 12, the second member 14, and the connecting members 16. For example, the first member 12, the second member 14, and the connecting members 16 can have thickness and width dimensions of nominally 2×6 inches, and the primary support members 17 can have thickness and width dimension of nominally 2×4 inches.

Figure 14:
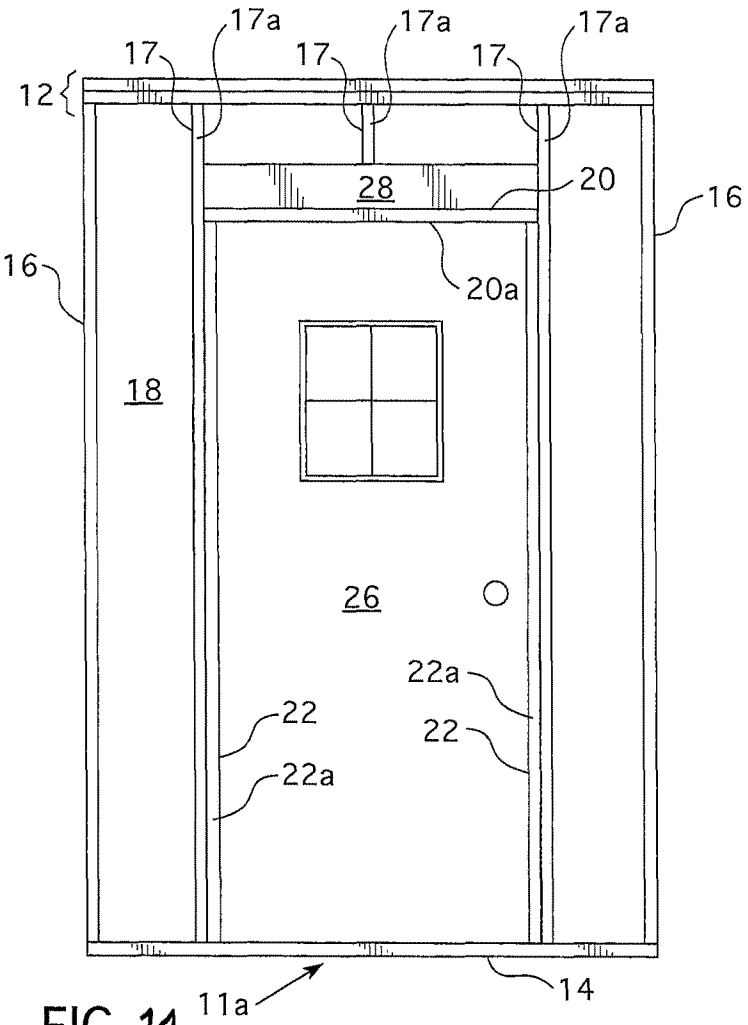
FIG. 14 is a front view of a wall structure frame with a door.
Figure 13:
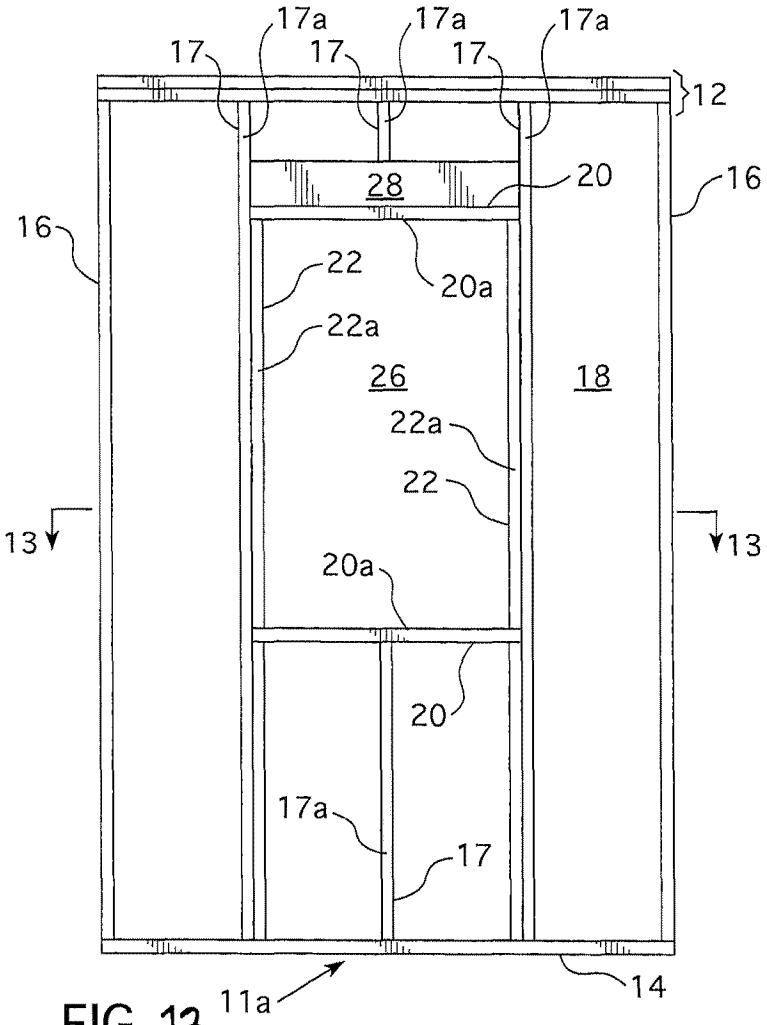
FIG. 13 is a front view of a wall structure frame with a window opening.

Referring to FIGS. 13 and 14, a wall structure can comprise one or more secondary support members 20, and/or tertiary support members 22. The secondary support members 20 and the tertiary support members 22 may comprise one or more plates, panels, beams, studs, or the like. The secondary support members 20 and the tertiary support members 22 can be incorporated into the frame 11 to provide additional structural support, for example, to form spaces for windows, doors, and the like. The secondary support members 20 and the tertiary support members 22 can have dimensions that are the same as or different than the primary support members 17, the members 16, the first member 12, and/or the second member 14. For example, the secondary support member 20 and the tertiary support members 22 can have shorter lengths than the primary support members 17, the members 16, the first member 12, and/or the second member 14.

As shown in FIGS. 13 and 14, the secondary support members 20 may have a front secondary support surface 20*a* and a rear secondary support surface (not shown in FIGS. 13 and 14) that correspond with the front and rear frame surfaces 11*a* and 11*b*, and the front and rear primary support surfaces 17*a* and 17*b*. Similarly, the tertiary support members 22 may have a front tertiary support surface 22*a* and a rear tertiary support surface 22*b* (see FIG. 17) that correspond with the front and rear frame surfaces 11*a* and 11*b* and the front and rear primary support surfaces 17*a* and 17*b*.

The secondary support members 20 extend between and attach to the primary support members 17, or alternatively, the secondary support members 20 extend between and attach to a primary support member 17 and a member 16. The tertiary support members 22 extend between two secondary support members 20 or between a secondary support member 22 and the first member 12 and/or the second member 14.

The secondary support members 20, the tertiary support members 22, the primary support members 17, the members 16, the first member 12, and/or the second member 14 form a secondary cavity 26. As shown in FIGS. 13 and 14, the secondary cavity 26 can be used as a space for a window, a door, or any other opening. For example, the secondary support members 20, the tertiary support members 22, the primary support members 17, the members 16, the first member 12, and the second member 14 can be constructed as a conventional industry standard rectangular or square wall panel having a window, door, or any other opening. For example, referring to FIG. 13, a rectangular or square wall structure having a window can be formed as follows: a first member 12 and a second member 14 may be spaced apart and extend parallel to each other; connecting members 16 may extend between the first member 12 and the second member 14 in a direction perpendicular to the first member 12 and the second member 14; primary support members 17 may be positioned between the members 16 and extend between the first member 12 and the second member 14 in a direction perpendicular to the first member 12 and the second member 14; two secondary support members 20 may be spaced apart and extend between the primary support members 17 in a direction parallel to the first member 12 and the second member 14; and two tertiary support members 22 may be spaced apart and extend between the two secondary members 20 in a direction perpendicular to the secondary support members 20 and the first member 12 and the second member 14. In addition, the primary support members 17 can also extend between the secondary members 20 and the first member 12 and/or the second member 14. As shown in FIG. 13, a secondary cavity 26 may be formed between the secondary support members 20 and the tertiary support members 22. The resulting rectangular or square wall panel can be used in a residential home or building. The shape and design of the frame 11 of the wall structure 10 is not so limited and can assume any shape and design as desired.

Additional support members and structural elements may also be used depending on the intended use of the wall structure 10. For example, and as shown in FIGS. 13 and 14, a header 28 may be used to provide additional support for a door or window. Other additional support members may be used for structural purposes, design purposes, and the like.

Figure 16B:
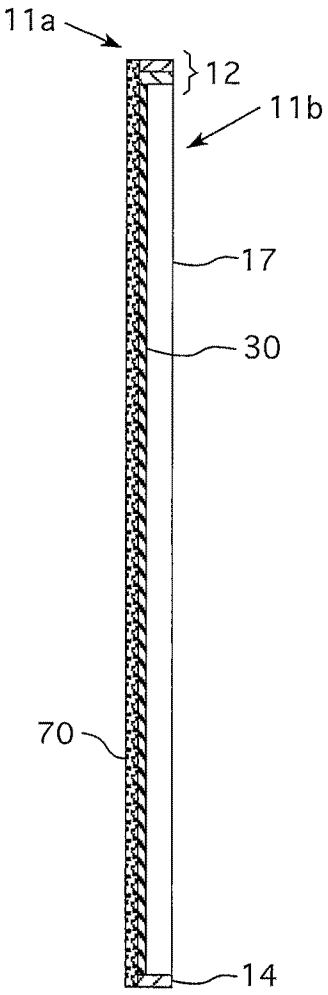
FIG. 16B is a side cross-sectional view of the wall structure shown in FIGS. 11 and 12.
Figure 16A:
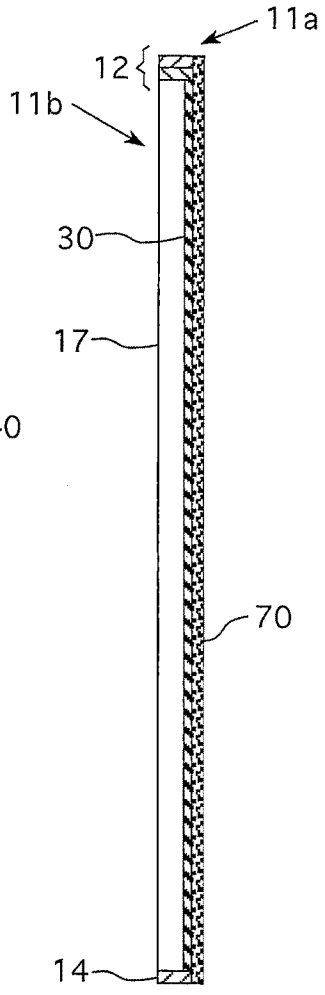
FIG. 16A is a side cross-sectional view of the wall structure shown in FIGS. 11 and 12.
Figure 15:
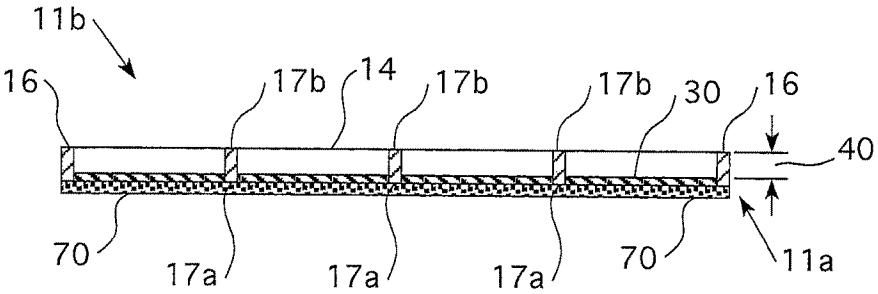
FIG. 15 is a top cross-sectional view of the wall structure shown in FIGS. 11 and 12.

Referring to FIGS. 15, 16A, and 16B, a first foam panel 70 may be attached to at least a portion of the front frame surface. As described above, the first foam panel 70 can comprise, for example, a polyiso foam panel, an expanded polystyrene foam panel, or an extruded polystyrene panel.

In one specific example, the first foam panel 70 comprises a polyiso panel. Compared to polyurethane foams, polyiso foams have a much higher isocyanate content. Through the use of certain catalysts the isocyanate is able to react with itself forming a ring-like structure (polyisocyanurate) that is very stable. Polyiso panels typically have a thickness which varies depending on the application. For example, a polyiso panel can have a thickness of about ½-inch to about 3-inches, or any sub-range subsumed therein such as, for example, about ¾-inch to about 2-inches. The polyisocyanurate foam layer of a polyiso panel may have a front face and a rear face, as described above.

The first foam panel 70 may be attached to the front frame surface by various attachment mechanisms. For example, the first foam panel 70 can be attached to the front frame surface by fasteners. The fasteners used to attach the first foam panel 70 to the front frame surface are not necessarily the same as the fasteners used to engage the first and second members, as described above. Suitable fasteners may include nails, staples, screws, bolts, or rivets, or a combination of any thereof. Because first foam panel 70 may comprise polyisocyanurate foam or foams having relatively low fastener pull-out strength, care must be used when mechanically fastening first foam panels 70 to frames so as not to damage the foam panels.

Alternatively, the first foam panel 70 can be attached to the front frame surface by the use of one or more adhesives. The adhesives may be selected from latex-based adhesives, reactive hot melts, polyester adhesives, polyamide adhesives, acrylic adhesives, one-component epoxy-based adhesives, one-component polyurethane-based adhesives, two-component polyurethane-based adhesives, and combinations of any thereof. Also, as described below, a foam material may be used as the adhesive. For example, a layer of foam may be applied to the first foam panel, the front frame surface, or both, before positioning and attaching the first foam panel to the front frame surface.

As described above, foam panels generally comprise facers on both sides of the core layer, which may be the same or different. As also described above, examples of suitable facer materials include, but are not limited to, fiberglass mats, glass fiber-reinforced cellulosic felts, coated and polymer-bonded fiber mats (e.g., fibrous glass mats bonded with an organic polymer binder and coated with an organic polymer coating, clay, or other inorganic coating), foils (e.g., aluminum foil), coated foils, foil/membrane laminates, foil/glass composites, and polyolefin films (such as TYVEK® materials, available from DuPont; or TYPAR® materials, available from Fiberweb, Inc.). The first foam panel may comprise a facer material attached to at least a portion of the front face and/or the rear face of the core layer. The facer material can cover the entire surface of the front face or the rear face or both the front and rear faces of the core layer. The facer material may advantageously promote adhesion of the foam layer 30 to the first foam panel 70. As described above, the facer material on the front face may be the same as or may be different than the facer material on the rear face.

The first foam panel 70 attached to the frame 11 may comprise multiple separate foam panels (i.e., multiple sections) which may be joined together by tape or caulk or polyurethane foam to form the first foam panel 70.

The foam layer 30, which adheres to the first foam panel 70 and the second foam panel 50, comprises a foam material deposited into the frame 11. Examples of foam material that can be used include foam materials made with polyurethane, polyurea, polyisocyanurate (also referred to as polyiso, as described above), and mixtures thereof. As described above, the foam material may be substantially free, may be essentially free, and may be completely free of halogen containing flame retardant additives.

As shown in FIGS. 11, 12, 15, 16A, and 16B, the foam material can be deposited into the frame 11 such that the foam material forms a foam layer 30 within at least a portion of the frame 11 between the front frame surface 11*a* and the rear frame surface 11*b*, and adheres to the first foam panel 70 and the second foam panel 50 (not shown in FIGS. 11, 12, 15, 16A and 16B).

Referring to FIGS. 15, 16A, and 16B, the foam layer 30 can be dimensioned to expand to a position intermediate the front frame surface 11*a* and the rear frame surface 11*b*, thereby forming a gap 40 within the wall structure 10 between the foam layer 30 and the rear frame surface 11*b*. FIGS. 11 and 12 further show that the gap 40 can be used as an area to incorporate home utility components 42 such as electrical wires, cords, heating and cooling pipes, and plumbing fixtures (which may be further positioned through a penetration opening (not shown in FIGS. 11 and 12) in the foam layer 30, the first foam panel 70, and a second foam panel 50 (not shown in FIGS. 11 and 12)). These home utility components may be inserted into the gap 40 located between the foam layer 30 and the rear frame surface 11*b* such that utilities components are not surrounded by or contacting the foam layer 30. In one example, the gap 40 comprises at least two inches as measured between the foam layer 30 and the rear frame surface 14.

Figure 17:
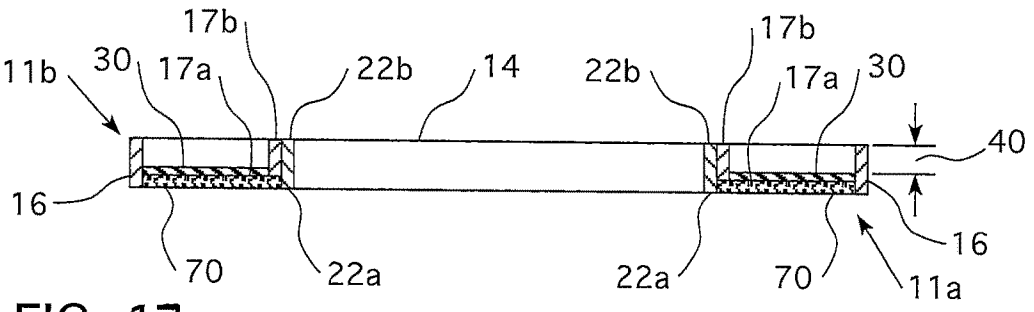
FIG. 17 is a top cross-sectional view of the wall structure of FIG. 13, at the vertical position where the window opening is located.

When secondary support members 20 and/or tertiary support members 22 are used with the foam wall structure 10 to form a secondary cavity 26, the secondary cavity 26 can be free of foam. For example, the foam layer 30 does not extend beyond and over the front secondary support surfaces 20*a* of the secondary members 20, the front tertiary support surfaces 22*a* of the tertiary support members 22, and/or beyond and over at least a portion of the front surfaces of other members that help form the secondary cavity 26. FIG. 17, for example, shows a top cross-sectional view with the foam layer 30 not extending beyond the front tertiary support surface 22*a* of the tertiary members 22. In such cases, corresponding openings may also be present in the first foam panel 70. Such openings in the first foam panel 70 can be formed by cutting out portions of the first foam panel 70 that cover portions of the wall structure that are to be free of foam, such as door and/or window frames. These cut out portions of the first foam panel 70 can, if desired, be used as second foam panel 50, thereby reducing the amount of waste foam panel produced.

The foam layer 30 can be formed in-situ during the manufacturing process. The term "formed in-situ during the manufacturing process," as used in this specification, refers to the formation of a foam layer 30 as described in this specification during manufacturing of the foam wall structure 10 off-site at a facility remote or away from a building construction site. As such, the foam layer 30 may be formed not at a construction site as is required by conventional methods, but instead as a component of the pre-fabricated wall structure 10. As used herein, "pre-fabricated" means that the wall structure is manufactured at a facility remote from a building construction site.

The foam layer 30 is able to fill tight spaces and seal gaps that may not be visible to the naked eye. The foam layer 30 can also act as a vapor and thermal insulating barrier, which reduces energy consumption in buildings and residential homes when the wall structure 10 is used as a constituent wall panel. The foam layer 30 may provide structural stability to the wall structure 10, such as improved wall racking strength, which refers to the ability of a wall structure to maintain its shape under shear stress. Additionally, as described above, the foam layer 30 may adhere to second foam panel 50, which secures the second foam panel 50 in place relative to the rear surface 70*b* of the first foam panel 70.

The present specification is also directed to methods of manufacturing a wall structure. A method of making a wall structure includes attaching the first foam panel 70 to the front frame surface 11*a*; positioning the second foam panel 50 within the cavity 18 and in contact with the rear surface 70*b* of the first foam panel 70; depositing the foam layer 30 into the cavity 18 in gaps between: (a) the second foam panel 50, and (b) the first member 12, the second member 14 and/or the connecting members 16, so that the foam layer 30 covers the gaps; and allowing the foam layer to cure. The frame can optionally having at least one primary support member and can be constructed in accordance with any of the examples described in this specification and shown in the drawings (see, for example, FIGS. 11-17). A first foam panel 70 is attached to the frame 11 at the front frame surface 11*a*, as described above.

Referring to FIGS. 18-21, after constructing or otherwise providing the frame 11, optionally with at least one primary support member 17, and attaching a first foam panel 70, the front frame surface 11*a* can be orientated over a rigid surface 51 such that the front frame surface 11*a* is positioned parallel or at least substantially parallel to the rigid surface 51. A "rigid surface" refers to any surface that is capable of receiving the frame 11 without bending, flexing, or moving. As shown in FIGS. 18-21, the rigid surface 51 has a width equal to or greater than the width of the front frame surface 11*a* and a length equal to or greater than the length of the front frame surface 11*a*. The rigid surface 51 may be positioned horizontally (as shown), vertically, or at an angle ranging from zero degrees to 90-degrees from the horizontal.

After orientating the front frame surface 11*a* over the rigid surface 51, a second foam panel (not shown in FIGS. 18-21) may be positioned within the cavity 18 in the frame 11 and in contact with a rear-facing surface of the first foam panel 70, as described above, and a foam material may be deposited into the frame 11. The foam material may be deposited into the frame 11 with an automated delivery device. Alternatively, the foam may be deposited into the frame 11 using various other devices including, but not limited to, a foam dispensing gun that is controlled and carried by an individual user. As shown in FIGS. 18-21, the foam material may be deposited into the frame 11 with an automated foam dispensing rig 60 that can be calibrated to dispense a pre-determined amount of foam. The foam dispensing rig 60 can include one or more nozzles 62. The nozzles 62 can be positioned over the frame 11 of the wall structure 10 so that each nozzle 62 sprays or pours foam into cavities 18 located within the frame 11 such as the cavities 18 shown in FIG. 18. A foam dispensing rig 60 with a plurality of nozzles 62 makes it possible to dispense foam quickly and efficiently. The nozzles 62 can controllably move into different positions.

Figure 18:
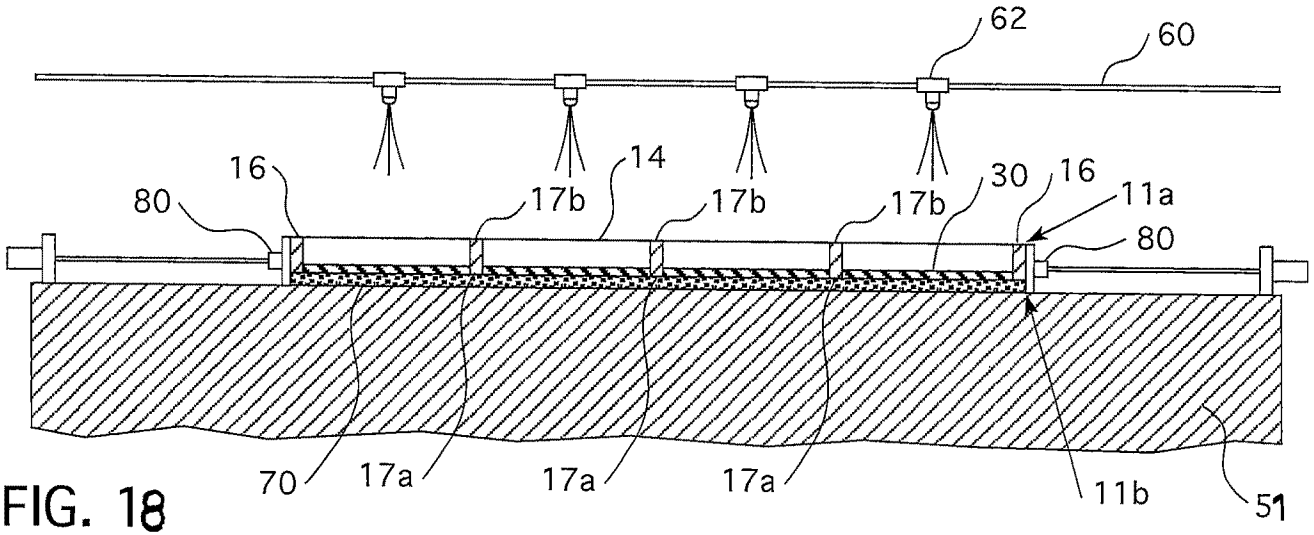
FIG. 18 is a top cross-sectional view of foam material being deposited into a frame.
Figure 19:
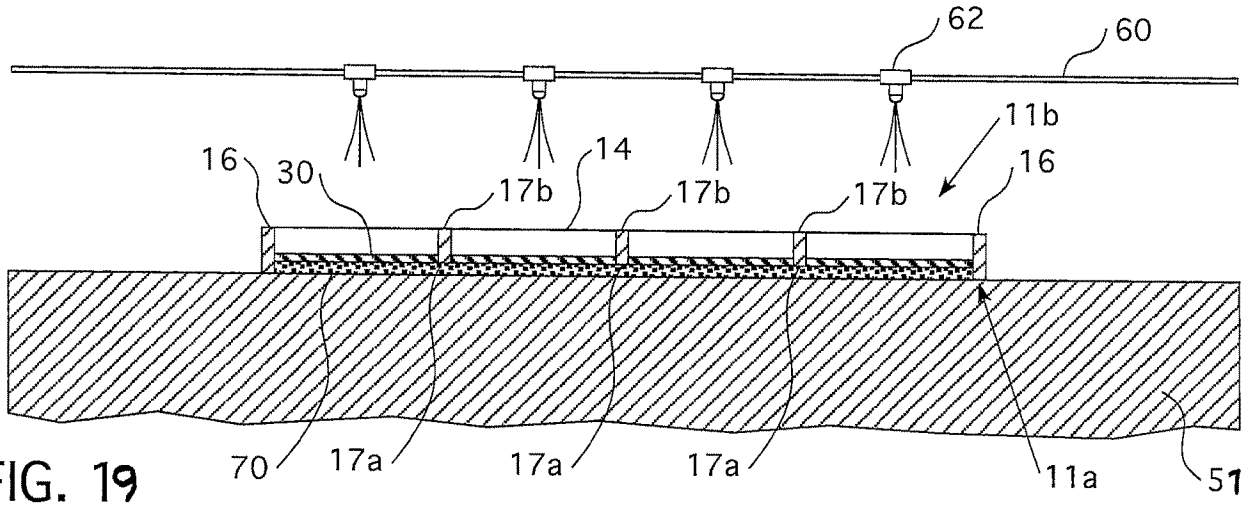
FIG. 19 is a top cross-sectional view of foam material being deposited into a frame.
Figure 20:
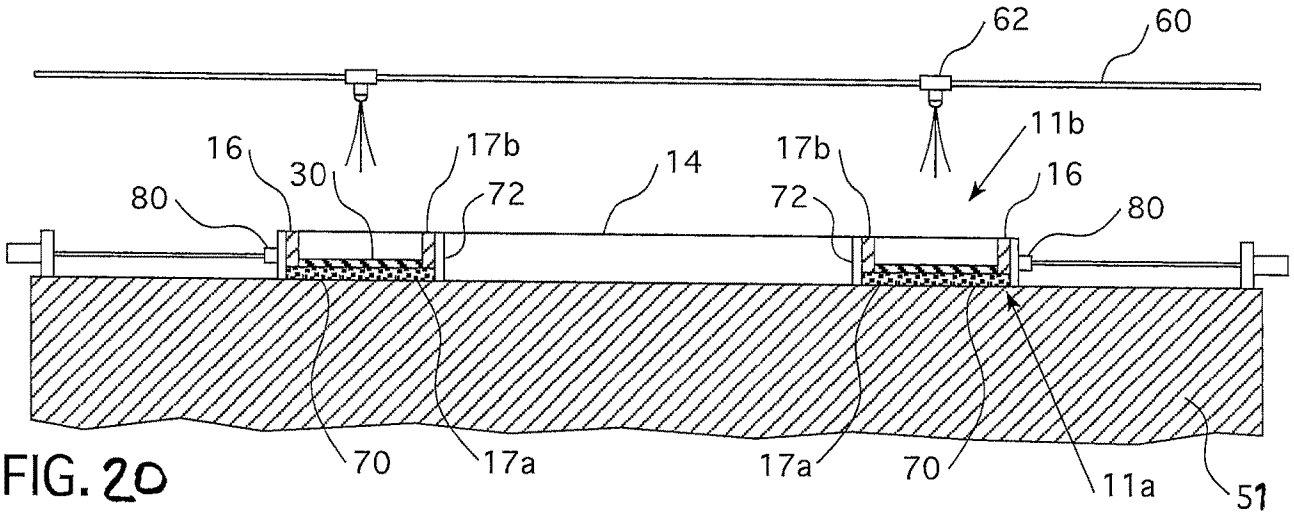
FIG. 20 is a top cross-sectional view of foam material being deposited into a frame.

Still referring to FIGS. 18-21, the foam material may be deposited into the frame 11 so that the foam material contacts the rear surfaces of the first foam panel 70 and the second foam panel 50 (not shown in FIGS. 18-21). As shown in FIG. 20, the foam material may be deposited so that the foam layer 30 extends beyond the front primary support surfaces 17*a* and the front frame surface 11*a*. Alternatively, as shown in FIGS. 18 and 19, the foam material may be deposited into the frame 11 so that the foam layer 30 does not extend beyond the front frame surface 11*a*. Accordingly, the foam material can be deposited into the frame 11 so that a foam layer 30 forms and may be flush with the front frame surface 11*a* or contained between the front frame surface 11*a* and the rear frame surface 11*b*.

As shown in FIGS. 18 and 19, the foam material can be deposited into the frame 11 so that the foam layer 30 can expand to a position intermediate the front frame surface 11*a* and rear frame surface 11*b*. A gap or opening 40 can therefore be formed between the foam layer 30 and the rear frame surface 11*b* to incorporate home utility components 42 such as electrical wires, cords, heating and cooling pipes, and plumbing fixtures, as can be seen in FIGS. 11 and 12. As shown in FIG. 20, a barrier 72 may be positioned between adjacent primary support members 17 to prevent foam material from expanding into undesired areas (e.g., window or door opening). A clamp 80 may be placed around the perimeter of the frame 11 hold the frame while the foam is deposited inside the frame 11.

As shown in FIG. 19, the front frame surface 11*a* can be placed over the rigid surface 51 without elevating the frame 11. The foam material can be deposited into the frame 11 such that a foam layer 30 is formed flush with the front primary support surfaces 17*a* and not the front frame surface 11*a*.

Figure 21:
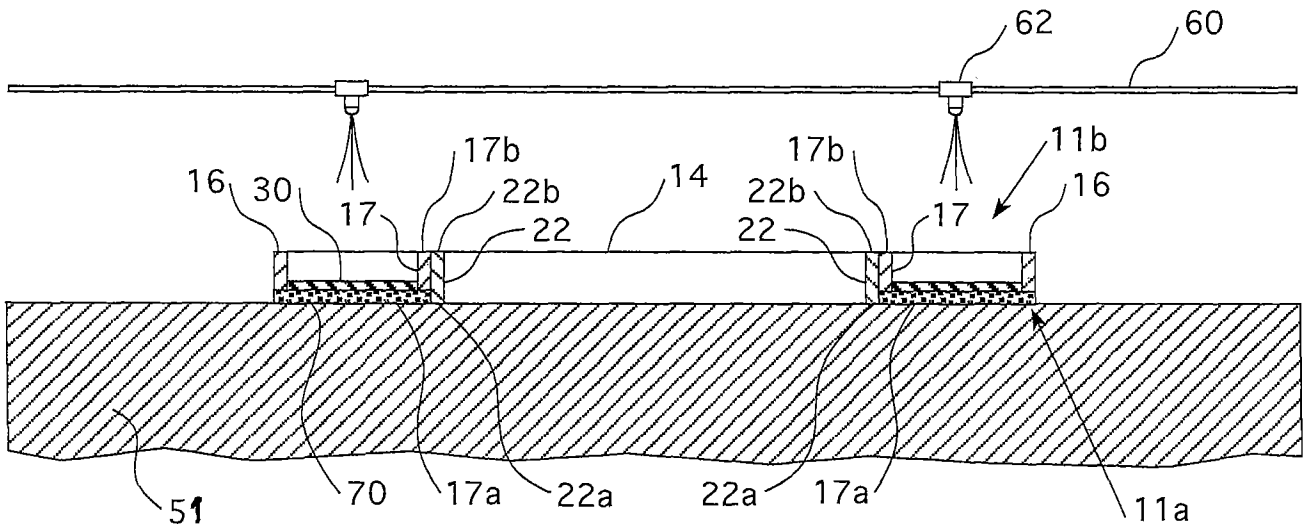
FIG. 21 is a top cross-sectional view of foam material being deposited into a frame.

As described above, the wall structure 10 can also include secondary support members 20 and tertiary support members 22 that form a secondary cavity 26 within the frame 11. The described methods therefore include constructing or otherwise providing a frame 11 having one or more secondary support members 20 and tertiary support members 22. As shown in FIG. 21, to prevent deposited foam material from entering the secondary cavity 26, the dimensions of the secondary support members 20 and/or tertiary support members 22 have a greater height than the primary support members 17.

After the foam layer 30 has expanded and cured, the wall structure 10 can be removed from the rigid surface 51 and shipped to a job site for use as a wall panel. Accordingly, the present specification is also directed to a pre-fabricated wall panel comprising the wall structure described in this specification.

The wall structure can be installed without any additional steps, thereby reducing the number of sub-contractors necessary to complete the installation of a wall at a construction site. In addition, the wall structure does not require additional materials such as exterior OSBs, and house wrap that are typically used in current residential building practices. Therefore, the wall structures described in this specification can decrease construction costs and/or decrease the overall cost per square foot per R-value.

The wall structures described in this specification also can impart a higher wall racking strength and improve thermal performance in comparison to existing wall solutions through the combination of the foam layer and the foam panels. Further, the wall structures described in this specification can help meet future R-value industry standards that are expected to increase in certain regions. With current fiberglass insulation, builders would have to convert 2×4-based wall designs to 2×6-based wall designs to ensure enough wall cavity capacity for additional insulation to meet such higher standards.

The wall structures described in this specification can also improve the consistency of installed insulation, and make it easy to install electrical and plumbing components, including components connected to exterior fixtures. The wall structures described in this specification can be used in new building construction or in retrofit or repair applications.

EXAMPLES

Examples 1-3

2×4 studded 24 inch OC 4 foot×8 foot wall panels were backed with a 1 inch thick polyisocyanurate (polyiso) rigid wall insulation panel having a closed cell polyisocyanurate foam core, faced with a coated glass-mat facer on both sides available from Hunter Panels, Portland, Me., as Hunter Xci CG. A 2" thick Hunter Xci CG polyiso panel was cut in a rectangular shape so that it left a 2 inch gap between the panel and the wooden studs of the wall panel on all sides when set inside the cavity defined by the first polyiso panel and the wood frame members. In Example 1, the inset 2" thick polyiso panel was glued in place using a construction flooring adhesive. In Example 2, the inset 2" thick polyiso panel was held in place, prior to application of spray foam, only with a few tacks (which were removed after application of spray foam). A polyurethane spray foam (Bayseal® CC STR, commercially available from Covestro LLC) was sprayed applied only along the 2 inch gap to seal the gap between the stud cavity and the inset 2" thick polyiso panel and adhere to the polyiso panels. Comparative Example 3 was prepared in the same manner as Examples 1 and 3, except that no inset 2" thick polyiso panel was used and the spray foam was applied such that a continuous layer of spray foam filled the entire cavity. The resulting walls were tested according to ASTM E72-15 and pushed to failure at the standard testing force rate found in ASTM E72-15. Results are set forth in the following Table:

| Example | Maximum Force | Displacement at Maximum Force | Modulus[1] |
|---|---|---|---|
| 1 | 2023 lbf (8999 N) | 0.28 ft (0.086 m) | 7225 lbf/ft (105,000 N/m) |
| 2 | 2386 lbf (10613 N) | 0.31 ft (0.096 m) | 7697 lbf/ft (110,000 N/m) |
| 3 | 2344 lbf (10427 N) | 0.32 ft (0.098 m) | 7325 lbf/ft (106,000 N/m) |

[1]Modulus is Maximum Force divided by Displacement at Maximum Force

As is apparent, Examples 1 and 2 performed similarly to Comparative Example 3 in terms of modulus, but used significantly less spray foam.

Various features and characteristics of the inventions are described in this specification to provide an overall understanding of the disclosed wall structures and method of manufacture. It is understood that the various features and characteristics described in this specification can be combined in any suitable manner regardless of whether such features and characteristics are expressly described in combination in this specification. The Applicant expressly intends such combinations of features and characteristics to be included within the scope of this specification. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description and sufficiency of description requirements (e.g., 35 U.S.C. § 112(a) and Article 123(2) EPC). The wall structures and methods disclosed in this specification can comprise, consist of, or consist essentially of the various features and characteristics described in this specification.

Also, any numerical range recited in this specification describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will not add new matter to the specification or claims, and will comply with written description and sufficiency of description requirements (e.g., 35 U.S.C. § § 112(a) and Article 123(2) EPC). Additionally, numerical parameters described in this specification should be construed in light of the number of reported significant digits, the numerical precision of the number, and by applying ordinary rounding techniques. It is also understood that numerical parameters described in this specification will necessarily possess the inherent variability characteristic of the underlying measurement techniques used to determine the numerical value of the parameter.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the described processes, compositions, and products. Further, the use of a singular noun includes the plural, and the use of a plural noun includes the singular, unless the context of the usage requires otherwise.

What is claimed is:

1. A wall structure comprising:

a frame comprising:

a first member;

a second member spaced apart from the first member; and nominally 2×4 or nominally 2×6 connecting members extending between the first member and the second member, wherein the first member, the second member, and the connecting members each comprise a front surface and a rear surface that form a front frame surface and a rear frame surface;

a first foam panel attached to the front frame surface, wherein:

(i) the first foam panel overlies the front frame surface, and (ii) the first foam panel, the first member, the second member, and the connecting members define a cavity within the frame;

a second foam panel, having a thickness of no more than 2 inches, disposed within the cavity and having a front surface that is in contact with a rear surface of the first foam panel and a rear surface facing away from the first foam panel; and a foam layer located within the cavity, wherein the foam layer adheres to the first foam panel and the second foam panel, the foam layer covers a portion of the rear surface of the second foam panel, and at least 10% of the surface area of the rear surface of the second foam panel is not covered by the foam layer.

2. The wall structure of claim 1, wherein no foam panel is in contact with a rear surface of the second foam panel so that at least a portion of the rear surface of the second foam panel is exposed, and wherein the foam layer is located in the cavity in gaps between: (a) the second foam panel, and (b) the first member, the second member, and the connecting members.

3. The wall structure of claim 2, wherein the second foam panel is not attached to the first foam panel with an adhesive.

4. The wall structure of claim 3, wherein the second foam panel is not directly attached to the first member, the second member or the connecting members.

5. The wall structure of claim 1, wherein at least 70% of the surface area of the rear surface of the second foam panel is not covered by the foam layer.

6. The wall structure of claim 1, wherein at least 50% of the surface area of the rear surface of the second foam panel is not covered by the foam layer.

7. The wall structure of claim 1, wherein the second foam panel covers at least 10% of the surface area of the cavity.

8. The wall structure of claim 1, wherein the second foam panel covers at least 50% of the surface area of the cavity.

9. The wall structure of claim 1, wherein the second foam panel is attached to the first foam panel with an adhesive.

10. The wall structure of claim 1, wherein the first foam panel is attached to the front faces of the first and second members, and to the front faces of the connecting members, with fasteners.

11. The wall structure of claim 1, wherein the foam layer comprises a thickness extending from the rear surface of the first foam panel to a position intermediate the front frame surface and the rear frame surface such that a gap having a width of at least 1 inch is formed within the frame between a rear surface of the foam layer and the rear frame surface.

12. The wall structure of claim 1, wherein the foam layer comprises polyurethane, polyurea, or polyisocyanurate, or a mixture thereof.

13. The wall structure of claim 1, wherein the first foam panel and the second foam panel comprise a foam layer comprising polyisocyanurate, expanded polystyrene, or extruded polystyrene.

14. The wall structure of claim 13, wherein the first foam panel and the second foam panel consist of a polyisocyanurate foam layer and a facer material attached to a front face and a rear face of the polyisocyanurate foam layer.

15. The wall structure of claim 14, wherein the facer material consists of aluminum foil, glass fiber reinforced cellulosic felt, or coated polymer-bonded glass fiber mat.

16. The wall structure of claim 14, wherein the facer material consists of coated polymer-bonded glass fiber mat.

17. The wall structure of claim 1, wherein the second foam panel comprises a plurality of second foam panels.

18. The wall structure of claim 1, wherein the second foam panel has a dimension such that horizontal edges of the panel are no more than 4 inches shorter than the width of the cavity and/or has a dimension such that the vertical edges of the panel are no more than 4 inches shorter than the distance between the first member and the second member.

19. A wall structure comprising:

a frame comprising:

a first member;

a second member spaced apart from the first member; and nominally 2×4 or nominally 2×6 connecting members extending between the first member and the second member, wherein the first member, the second member, and the connecting members each comprise a front surface and a rear surface that form a front frame surface and a rear frame surface;

a first foam panel attached to the front frame surface, wherein:

(i) the first foam panel overlies the front frame surface, and (ii) the first foam panel, the first member, the second member, and the connecting members define a cavity within the frame;

a second foam panel, having a thickness of no more than 2 inches, disposed within the cavity and having a front surface that is in contact with a rear surface of the first foam panel and a rear surface facing away from the first foam panel;

a foam layer located within the cavity, wherein the foam layer adheres to the first foam panel and the second foam panel, the foam layer covers a portion of the rear surface of the second foam panel, and at least 10% of the surface area of the rear surface of the second foam panel is not covered by the foam layer, and wherein no foam panel is in contact with a rear surface of the second foam panel and at least a portion of the rear surface of the second foam panel is not covered by the foam layer so that at least a portion of the rear surface of the second foam panel is exposed, and wherein the foam layer is located in the cavity in gaps between: (a) the second foam panel, and (b) the first member, the second member, and the connecting members.

20. The wall structure of claim 19, wherein the foam layer comprises a thickness extending from the rear surface of the first foam panel to a position intermediate the front frame surface and the rear frame surface such that a gap having a width of at least 1 inch is formed within the frame between a rear surface of the foam layer and the rear frame surface.

21. The wall structure of claim 19, wherein the first foam panel and the second foam panel comprise a foam layer comprising polyisocyanurate, expanded polystyrene, or extruded polystyrene.

22. The wall structure of claim 21, wherein the first foam panel and the second foam panel consist of a polyisocyanurate foam layer and a facer material attached to a front face and a rear face of the polyisocyanurate foam layer.

23. The wall structure of claim 22, wherein the facer material consists of aluminum foil, glass fiber reinforced cellulosic felt, or coated polymer-bonded glass fiber mat.

24. The wall structure of claim 22, wherein the facer material consists of coated polymer-bonded glass fiber mat.

* * * * *